US006264191B1

(12) United States Patent
Suzuki et al.

(10) Patent No.: US 6,264,191 B1
(45) Date of Patent: Jul. 24, 2001

(54) SHEET DISCHARGING APPARATUS AND A SHEET DISCHARGING METHOD

(75) Inventors: Nobuyoshi Suzuki, Shinagawa-ku; Masahiro Tamura, Yokohama; Yukitaka Nakazato, Edogawa-ku; Junichi Iida, Yokohama; Akihito Andoh, Kawasaki, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/362,713

(22) Filed: Jul. 29, 1999

(30) Foreign Application Priority Data

Jul. 31, 1998 (JP) ..... 10-217811
May 14, 1999 (JP) ..... 11-134253

(51) Int. Cl.[7] ..... B65H 29/34
(52) U.S. Cl. ..... 271/189; 271/306
(58) Field of Search ..... 271/306, 189, 271/213, 220, 182, 218

(56) References Cited

U.S. PATENT DOCUMENTS 4,406,449 * 9/1983 Buck ..... 271/220
4,629,174 * 12/1986 Wakisaka et al. ..... 271/218
6,095,518 * 8/2000 Allenendinger et al. ..... 271/220

FOREIGN PATENT DOCUMENTS

0262644 * 12/1988 (DE) ..... 271/220
0212350 * 12/1984 (JP) ..... 271/306
5-43122 2/1993 (JP) .
6-166456 6/1994 (JP) .
6-329320 11/1994 (JP) .
7-45498 10/1995 (JP) .

* cited by examiner

*Primary Examiner*—H. Grant Skaggs
(74) *Attorney, Agent, or Firm*—Oblon, Spivak, McClelland, Maier & Neustadt, P.C.

(57) ABSTRACT

A sheet discharging apparatus including a sheet discharging device which discharges a sheet on a sheet discharging tray. A sheet tip portion guide device holds thereupon a tip portion of the sheet discharged from the sheet discharging device, guides the sheet in a sheet discharging direction while holding the tip portion of the sheet thereupon, and releases the sheet by releasing the tip portion of the sheet held thereupon.

21 Claims, 28 Drawing Sheets

BACKGROND ART

SHEET DISCHARGING APPARATUS AND A SHEET DISCHARGING METHOD

BACKGROUND OF THE INVENTION

1. Field of the Invention

This invention relates to a sheet discharging apparatus included in an image forming apparatus or a sheet post-processing apparatus connected with the image forming apparatus.

2. Discussion of the Background

In a background sheet post-processing apparatus, for example, as illustrated in FIG. 23, a sheet discharging device is provided at a discharging exit, which includes a sheet discharging roller 200 as a driving roller, and a driven roller 202 which can contact and separate from the sheet discharging roller 200. The sheet discharging device is configured to discharge a sheet or a set of stapled sheets on a sheet discharging tray 206 with the sheet or the set of stapled sheets sandwiched and conveyed between the sheet discharging roller 200 and the driven roller 202.

The height of the sheets stacked on the sheet discharging tray 206 is detected by a sheet surface detecting device which includes a sheet surface detecting lever 208 positioned at substantially a center of a sheet discharging tray 206, and sensors 210 and 212. When the height of the sheets stacked on the sheet discharging tray 206 reaches a predetermined height, the sheet discharging tray 206 is driven to move down so as to receive additional discharging sheets. If the sheet discharging tray 206 is fixed to the sheet post-processing apparatus, the above-described sheet surface detecting device functions as a full stacked sheets detecting device which detects that the sheets are stacked to the full capacity on the sheet discharging tray 206.

Referring to FIG. 23, a reference numeral 214 designates a guide plate which guides the sheet or the set of stapled sheets to the discharging exit of the sheet post-processing apparatus, a reference numeral 216 designates a discharging sensor, and a reference numeral 218 designates a pullback roller which pulls back the discharged sheet to an end fence (not shown) of the sheet discharging tray 206 so as to align the trailing edge of the discharged sheet.

As illustrated in FIG. 23, when the set of stapled sheets 204 is discharged on the sheet discharging tray 206, the stapled sheets 204 are prone to have so-called back curls, i.e., the tip portion of the stapled sheets 204 is curled downward by gravity depending on thickness, weight, or material of the stapled sheets 204. The back curl increases an angle ($\alpha$) formed between the stapled sheets 204 and the surface of the sheet discharging tray 206 at the contact point of the tip portion of the stapled sheets 204 with the surface of the sheet discharging tray 206.

If the discharging operation of the set of stapled sheets 204 continues in the above back curl condition, the stapled sheets 204 may be stacked on the sheet discharging tray 206 with its tip portion bent inward, i.e., the tip portion of the stapled sheets 204 U-shaped, as illustrated in FIG. 24. The above-described bend of the stapled sheets 204 may cause inadequate stacking and a detection error of the sheet surface detecting device.

The above-described sheet tip portion bending problem occurs not only in the discharged set of stapled sheets but also in the sheet which is discharged one by one on the sheet discharging tray 206.

In order to address the above-described sheet tip portion bending problem, as illustrated in FIG. 25, a known sheet discharging apparatus includes a protrusive member 220 on the surface of the sheet discharging tray 206 such that a relatively small angle is formed between the tip portion of a sheet or a stapled sheets 204 and the surface of the protrusive member 220. Thereby, bending of the sheet or the set of stapled sheets 204 is avoided. The protrusive member 220 is made detachable from the sheet discharging tray 206.

However, in the above-described sheet discharging apparatus with the protrusive member 220, when a sheet is discharged on the sheet discharging tray 206 one by one (hereinafter called a shift stack mode), the surface of a trailing end part of the stacked sheets is projected due to the protrusive member 220 as illustrated in FIG. 26. In addition, the trailing edge of some sheets does not reach a position to contact a surface of the pullback roller 218 so as to be pulled down by the pullback roller 218 to be abutted against the end fence. As a result, some of the sheets cannot be pulled back surely to be abutted against the end fence, and thereby inadequate stacking is caused.

Moreover, because the surface of the stacked sheets is projected on the protrusive member 220, as illustrated in FIG. 27, a sheet stacking on the stacked sheets does not slide on the surface of the stacked sheets to the end fence by gravity after the trailing edge of the sheet falls down to the surface of the stacked sheet. As a result, the trailing edge of the sheet does not reach a position to contact a surface of the pullback roller 218 so as to be pulled down by the pullback roller 218 to be abutted against the end fence. Thereby, the sheet is not pulled back to be abutted against the end fence, and the sheet is stacked with its leading edge positioned forward.

Further, in the shift stack mode, when the sheet has so-called face curls at the trailing end portions thereof in the sheet discharging direction (i.e., the trailing end portions of the sheet are curled upward), and when the sheet is discharged on the protrusive member 220, the trailing edge of the sheet is positioned above the surface of the sheet discharging tray 206. As a result, the trailing edge of the sheet contacts the sheet discharging roller 200 and is pulled by the sheet discharging roller 200.

In light of the above-described inadequate sheet stacking, when the sheet is discharged in the shift stack mode or the sheet is prone to have face curls, the protrusive member 220 is detached from the sheet discharging tray 206 in the sheet discharging apparatus.

As stated above, in the background sheet discharging apparatus with the protrusive member 220, an operator is inconvenienced by having to detach and attach the protrusive member 220 according to the types of sheets and stacking mode. Further, when the protrusive member 220 is detached from the sheet discharging tray 206, the advantage of preventing the sheet tip portion bending problem may be abandoned.

In Japanese Laid-open Patent Publication No. 6-329320 of 1994, an image recording apparatus is described in which a recording condition of a sheet can be visually confirmed one by one in a sheet facedown discharging method.

As illustrated in FIG. 28, the characteristic of the above image recording apparatus is that a hook member 224 including a latch part 224*a* at its tip portion, is swingably provided in the vicinity of a downstream side of the sheet discharging device 222. The hook member 224 swings upward by being pushed by a recorded sheet P, and the sheet P is directed in the sheet discharging direction with the leading edge of the sheet P caught by the latch part 224*a* of the hook member 224. As the tip portion of the sheet P is turned up by being caught by the latch part 224*a* toward the front side, the recording condition on the underside of the sheet P can be confirmed visually. As the sheet P advances in the sheet discharging direction, the hook member 224 is pushed to swing upward, and then the leading edge of the sheet P is released from the latch part 224*a* and the sheet P falls down to be stacked.

In the above-described image recording apparatus of JP No. 6-329320, the sheet tip portion bending problem can be avoided because the tip portion of the sheet is turned up. However, when a sheet having a strong tension, such as a thick paper or a set of stapled sheets is discharged, the sheet or the set of stapled sheets configured to stretch between the latch part 224*a* and a discharging exit of the image recording apparatus due to the strong tension and the leading edge of the above sheet or sheets may not be released from the latch part 224*a* in an appropriate manner. As a result, inadequate discharging of the sheet or the sheets may be caused.

In another Japanese Utility Model Publication No. 7-45498, a sheet discharging apparatus is described in which a tip portion of a sheet is pinched by a claw on a chain and the sheet is transferred by driving the chain. The sheet is released from the claw at a predetermined position with a cam mechanism.

In the above-described sheet discharging apparatus of JP No. 7-45498, the sheet is discharged adequately without being bent, because the sheet is released from the claw at a designated position. However, a chain driving mechanism, and the cam mechanism which regulates the sheet release from the claw, increase the cost of the sheet discharging apparatus. In addition, because the sheet is transferred with the leading edge of the sheet pinched by the claw, a pinching mark remains at the leading edge of the sheet.

SUMMARY OF THE INVENTION

Accordingly, an object of this invention is to overcome the above-described and other problems with background sheet discharging apparatuses by providing a novel sheet discharging apparatus and method for discharging a sheet or sheets adequately, in which a sheet tip portion bending problem can be prevented with a simple configuration.

According to a preferred embodiment of the present invention, a sheet discharging apparatus includes a sheet discharging device which discharges a sheet on a sheet discharging tray. A sheet tip portion guide device holds a tip portion of the sheet discharged from the sheet discharging device, guides the sheet in a sheet discharging direction while holding the tip portion of the sheet, and releases the sheet by releasing the tip portion of the sheet held.

According to the present invention, the sheet tip portion guide device may include a holding member which holds the tip portion of the sheet and which moves in the sheet discharging direction with the tip portion of the sheet held by a pushing force of the sheet discharged from the sheet discharging device. Thus, the sheet is guided in the sheet discharging direction.

In addition, the holding member may be configured to swing so as to release the tip portion of the sheet by the pushing force of the sheet discharged from the sheet discharging device. The sheet discharging apparatus includes a swing regulation member so as to regulate swings of the holding member for a predetermined distance after the holding member starts to move by the pushing force of the sheet discharged from the sheet discharging device. The swing regulation member may include a shape curved upward in the sheet discharging direction. The sheet discharging apparatus may further include a catch device which catches the holding member at a position in which the holding member does not interfere with the discharged sheet.

The sheet discharging apparatus may further include a displacing device which displaces the swing regulation member such that the holding member is swung at an arbitrary position in the sheet discharging direction to release the tip portion of the sheet. Further, a plurality of the arbitrary positions may be set.

According to the present invention, the tip portion of the sheet may be released by making a moving speed of the holding member faster than a sheet discharging speed of the sheet discharging device. Further, a plurality of arbitrary positions to make the moving speed of the holding member faster than the sheet discharging speed of the sheet discharging device may be set.

The sheet discharging apparatus may further include a sheet release position switch device to select one of the plurality of the arbitrary sheet release positions.

According to the present invention, the sheet tip portion guide device may be configured so as to move to a position in which the sheet tip portion guide device does not interfere with the discharged sheet. The sheet discharging apparatus may further include a shifting device which shifts the sheet tip portion guide device to the position.

The sheet discharging apparatus may further include a control device which controls the shifting device so as to shift the sheet tip portion guide device selectively between a sheet guide position and the position in which the sheet tip portion guide device does not interfere with the discharged sheet according to a sheet process mode.

According to the present invention, the sheet discharging apparatus may further include a sheet correction member provided in the vicinity of the sheet discharging device to regulate a change of a shape of the sheet at substantially a central part of the sheet in the direction perpendicular to the sheet discharging direction.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
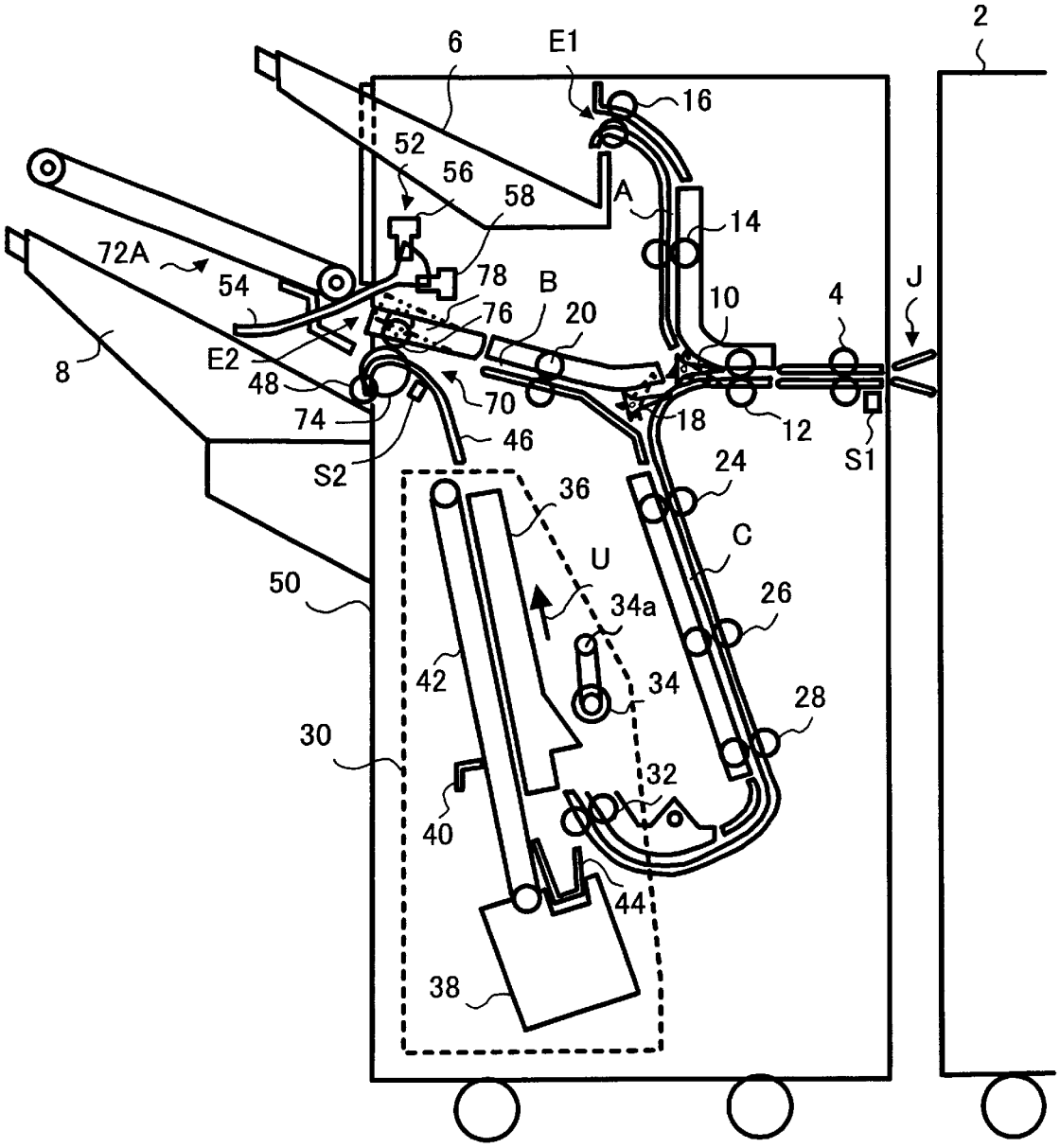
FIG. 1 is a side view illustrating an overall structure of a finisher including a sheet discharging apparatus of the present invention.

Referring now to the drawings, wherein like reference numerals designate identical or corresponding parts throughout the several views, and more particularly to FIG. 1 thereof, there is illustrated an overall structure of a sheet post-processing apparatus (hereinafter called a finisher) including a sheet discharging apparatus of the present invention.

In the embodiments of the present invention, the finisher is connected to a side of a photocopying machine 2 as an image forming apparatus. In the vicinity of a sheet transfer portion J which transfers a sheet from the photocopying machine 2 to the finisher, there arc provided an entrance sensor S1 and entrance rollers 4. A sheet transferred into the finisher by the entrance rollers 4 is discharged by one of the following three sheet discharging routes according to the sheet processing modes:

(1) the sheet is conveyed through a sheet discharging route A and is discharged from a discharging exit E1 to a proof tray 6 which is provided at an upper part of the finisher;

(2) the sheet is conveyed through a non-staple route B and is discharged from a discharging exit E2 to a sheet discharging tray 8 without a stapling operation; and (3) the sheet is conveyed through a staple route C and is discharged from the discharging exit E2 to the sheet discharging tray 8 after a stapling operation.

The sheet conveyed by transfer rollers 12 is directed to the sheet discharging route A leading to the proof tray 6 by a separation guide pick 10, which is disposed downstream from the entrance rollers 4. The sheet is conveyed by transfer rollers 12 and 14 in the sheet discharging route A and is then discharged on the proof tray 6 by discharging rollers 16. The separation guide pick 10 is driven by a solenoid (not shown). For directing the sheet to the sheet discharging route A and the proof tray 6, the separation guide pick 10 is positioned in a position illustrated by a two-dots-and-dash line in FIG. 1. The above-described rollers (i.e., the entrance rollers 4, the transfer rollers 12 and 14, and the discharging rollers 16), respectively include a drive and driven roller pair. Other transfer rollers and discharging rollers hereinafter denoted by a single numeral also include a drive and driven roller pair.

A separation guide pick 18 is disposed downstream of the separation guide pick 10, and directs a sheet, which is directed in the horizontal direction by the separation guide pick 10 that is illustrated by a solid line in FIG. 1, selectively to the non-staple route B in which a staple operation is not performed and to the staple route C in which a staple operation is performed. The separation guide pick 18 is also driven by a solenoid (not shown) and switches its position selectively between the position illustrated by a solid line in FIG. 1 (i.e., the position for forming the non-staple route B), and the position illustrated by a two-dots-and-dash line in FIG. 1 (i.e., the position for forming the staple route C).

In a non-staple mode (i.e., in a sort/stack mode), a sheet is conveyed in the non-staple route B by transfer rollers 20, and is then discharged to the sheet discharging tray 8 by a sheet discharging device 70 and a sheet tip portion guide device 72A (both described later). The sheet discharged on the sheet discharging tray 8 is pulled back to an end fence 50 by a sponge-made pullback roller 48 with the trailing edge of the sheet abutted against the end fence 50, so that the sheet is stacked on the sheet discharging tray 8 with the trailing edge of the sheet aligned.

In a staple mode, a sheet is conveyed in the staple route C by transfer rollers 24, 26, and 28 to a staple unit 30 in which a staple operation is performed. A set of stapled sheets is discharged to the sheet discharging tray 8 by the sheet discharging device 70 and the sheet tip portion guide device 72A.

A detailed operation of the finisher in the staple mode will now be described. The sheet directed to the staple route C is stacked on a staple tray (not shown) by discharging rollers 32. On the staple tray, the sheet is aligned in the sheet conveying direction one by one by a striking roller 34. The sheet is aligned in the sheet width direction (i.e., in the direction perpendicular to the sheet conveying direction) by a jogger fence pair 36. A stapler 38 is driven based on a staple signal transmitted from a control device (not shown) during an interval between jobs. That is, an interval between a time when a last sheet of a set of sheets is stacked and a time when a first sheet of a subsequent set of sheets is stacked in the staple tray. The set of stapled sheets is pushed up by a release belt 42 including a release pick 40 in the direction indicated by an arrow U in FIG. 1, and is then discharged to the sheet discharging tray 8 by the sheet discharging device 70 and the sheet tip portion guide device 72A. The set of stapled sheets discharged on the sheet discharging tray 8 is pulled back to the end fence 50 by the pullback roller 48 with the trailing edge of the sheets abutted against the end fence 50, so that the sheets are stacked on the sheet discharging tray 8 with the trailing edge of the sheets aligned.

The striking roller 34 is driven and swung by a solenoid (not shown) around a supporting point 34*a,* and periodically strikes the sheet fed to the staple tray so as to abut the sheet against an end fence 44. The striking roller 34 rotates in a counterclockwise direction. In FIG. 1, a reference numeral 46 indicates a guide plate, and a reference character S2 indicates a discharging sensor.

A sheet surface detecting device 52 is provided above the sheet discharging device 70. When the height of the stacked sheets on the sheet discharging tray 8 reaches a predetermined height, the sheet discharging tray 8 is driven to move down so as to receive additional discharged sheets. That is, the finisher according to the embodiments of the present invention adopts a configuration in which a large number of sheets can be discharged on the sheet discharging tray 8.

Figure 2:
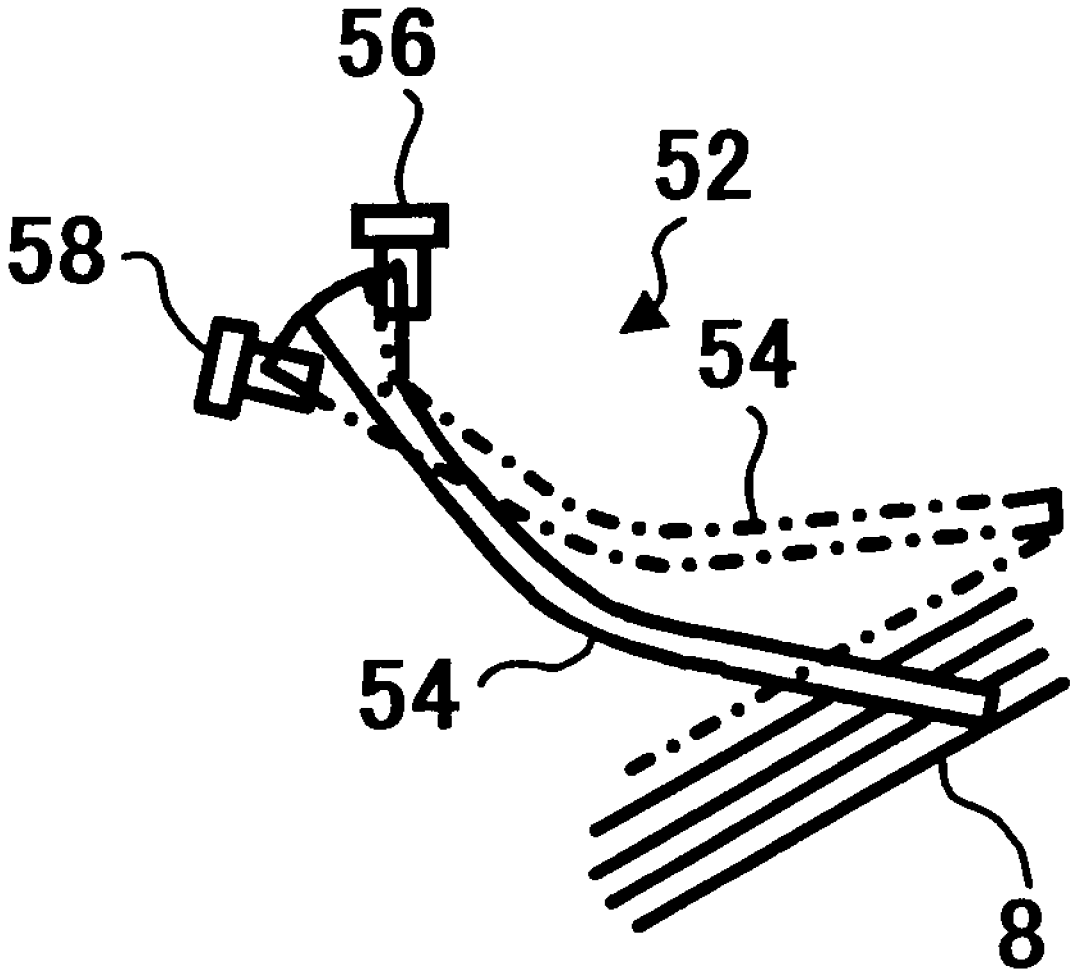
FIG. 2 is an explanatory view of an operation of a sheet surface detecting device of the finisher of FIG. 1.

The sheet surface detecting device 52 includes a sheet surface detecting lever 54 which is aligned with substantially the widthwise center of the sheet discharging tray 8. Also included are sensors 56 and 58 provided above the sheet discharging device 70. The sheet surface detecting operation of the sheet surface detecting device 52 is illustrated in FIG. 2. The sheet surface detecting lever 54 is supported so as to seesaw. One end of the sheet surface detecting lever 54 is disposed to contact the sheet discharging tray 8 when no sheet is stacked thereon as illustrated by a solid line in FIG. 2. As sheets are stacked on the sheet discharging tray 8, the one end of the sheet surface detecting lever 54 contacting the surface of the sheets stacked on the sheet discharging tray 8 is raised as illustrated by a two-dots-and-dash line in FIG. 2. Another end of the sheet surface detecting lever 54 is disposed so as to be detected by the sensors 56 and 58. The sensors 56 and 58 detect that the sheet discharging tray 8 is at the home position, the height of the stacked sheets on the discharging tray 8 exceeds a predetermined height, and so on, in cooperation with the sheet surface detecting lever 54.

Figure 3:
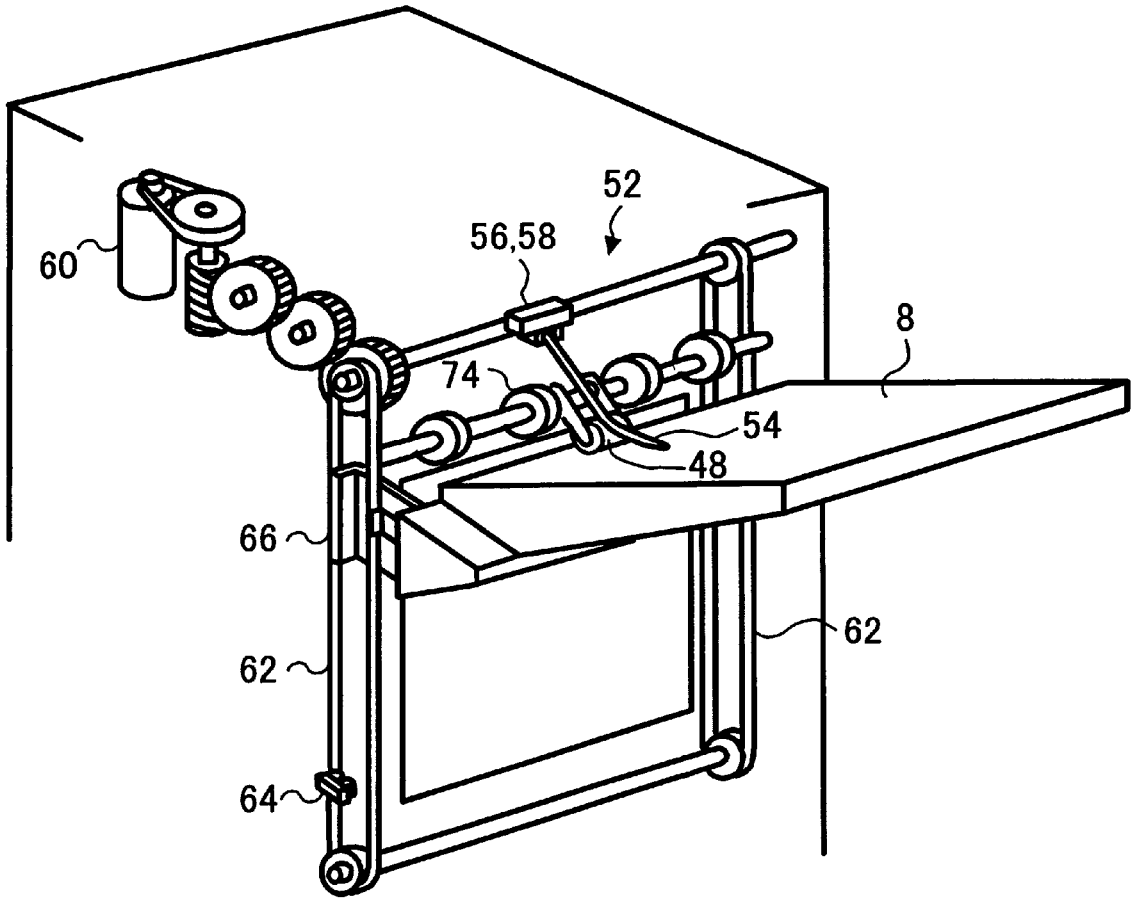
FIG. 3 is a perspective view illustrating a moving up and down mechanism of a sheet discharging tray of the finisher of FIG. 1.

As illustrated in FIG. 3, the sheet discharging tray 8 is provided with a pair of up-down lift belts 62 which are driven by an up-down motor 60 via gears and a timing belt. The discharging tray 8 moves up and down by forward and reverse rotations of the up-down motor 60. In the vicinity of a lower part of the up-down lift belts 62, a lower limit sensor 64 is provided. When an interception board 66, which is provided at one side of the sheet discharging tray 8, intercepts the lower limit sensor 64, the up-down motor 60 stops. Thereby, the sheet discharging tray 8 stops moving down at the position of the lower limit sensor 64, which is the lowest moving position of the sheet discharging tray 8.

Figure 4:
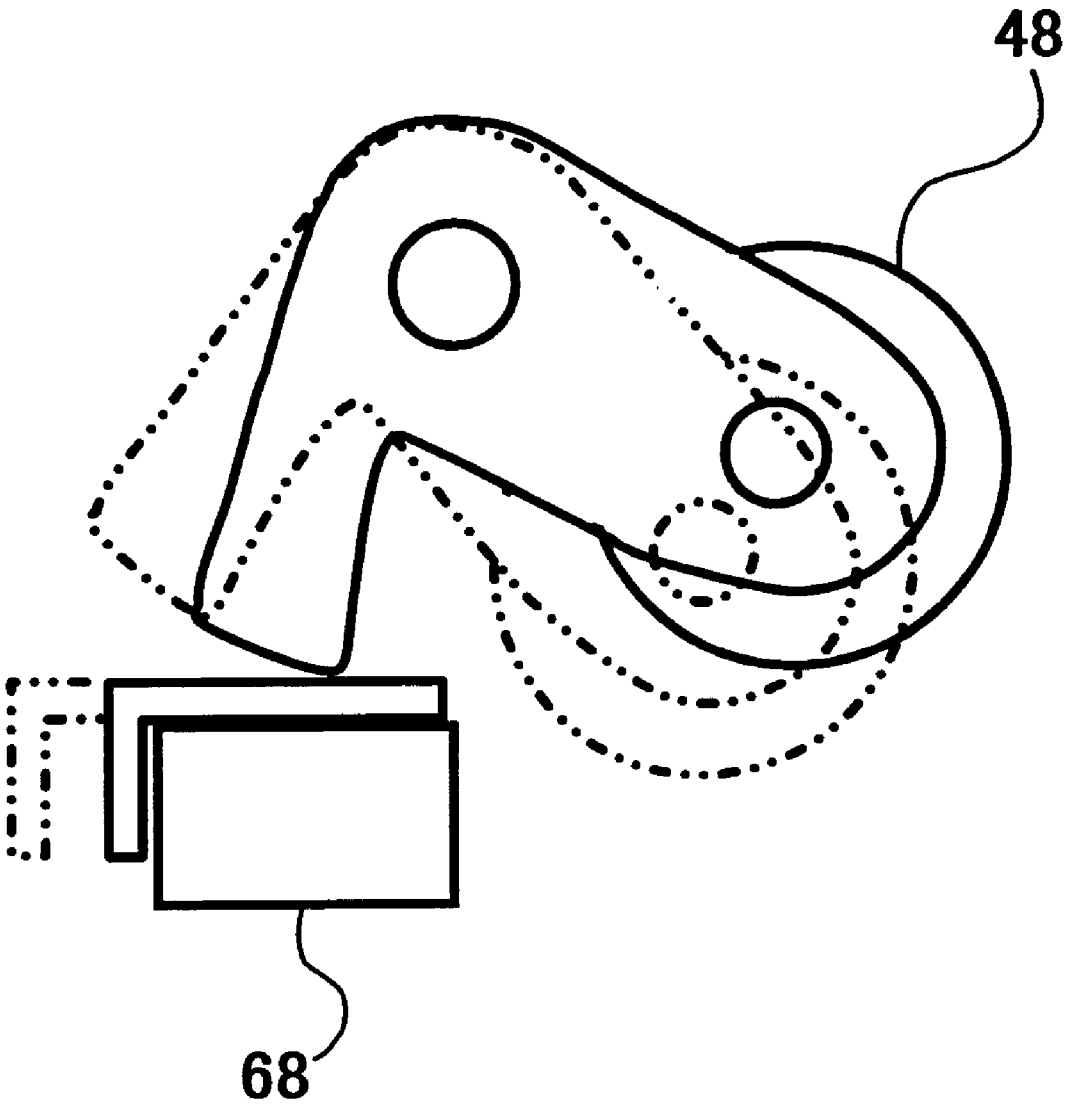
FIG. 4 is an explanatory view of an operation of an upper limit switch of the sheet discharging tray of the finisher of FIG. 1.

When the sheet discharging tray 8 is moved up, and the pullback roller 48 is pushed up by the sheet discharging tray 8, as illustrated by a solid line in FIG. 4, one end portion of the pullback roller 48 contacts an upper limit switch 68. Thereby, the upper limit switch 68 is turned off and the up-down motor 60 stops so that the sheet discharging tray 8 stops moving. Thus, breakage of the sheet discharging tray 8 which may be caused by its overrun is prevented.

Referring back to FIG. 1, the sheet discharging device 70 includes a discharge drive roller 74 and a discharge driven roller 76 which contacts and presses the discharge driver roller 74 by its gravity or a bias force of a spring (not shown) or the like. The driven roller 76 is provided so as to contact and separate from the drive roller 74 via a supporting plate 78 such that both a sheet and a set of stapled sheets can be discharged through the drive roller 74 and the driven roller 76. In the staple mode, the supporting plate 78 shifts upward, as illustrated by a two-dots-and-dash line in FIG. 1, so as to adjust a nip part between the discharging roller 74 and the driven roller 76 to the thickness of a set of stapled sheets.

Figure 5:
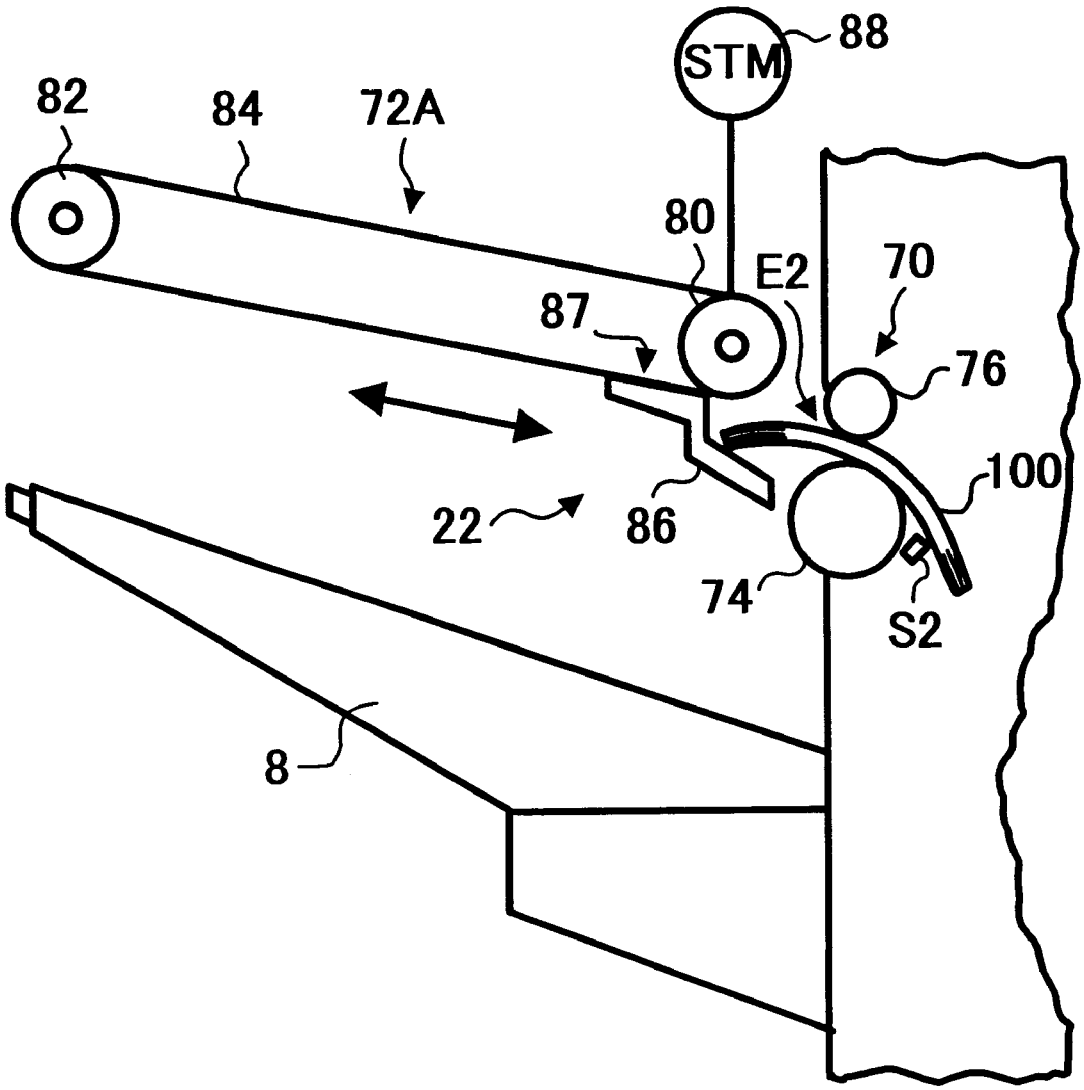
FIG. 5 is a side view illustrating a sheet discharging apparatus according to a first embodiment of the present invention.

Hereinafter, a sheet discharging apparatus according to a first embodiment of the present invention is described. Referring to FIG. 5, the sheet tip portion guide device 72A includes timing pulleys 80 and 82 which are supported by a bracket (not shown) fixed to the finisher; a timing belt 84 which is spanned around the timing pulleys 80 and 82; a holding member 86 which is provided to the timing belt 84 to receive and hold a tip portion of a sheet or a set of sheets discharged from the finisher; a home position detecting sensor 87 which detects a standby position (i.e. a home position), of the holding member 86; and a stepping motor 88 which drives the timing pulley 80 located at the upstream side in the sheet discharging direction.

Figure 6:
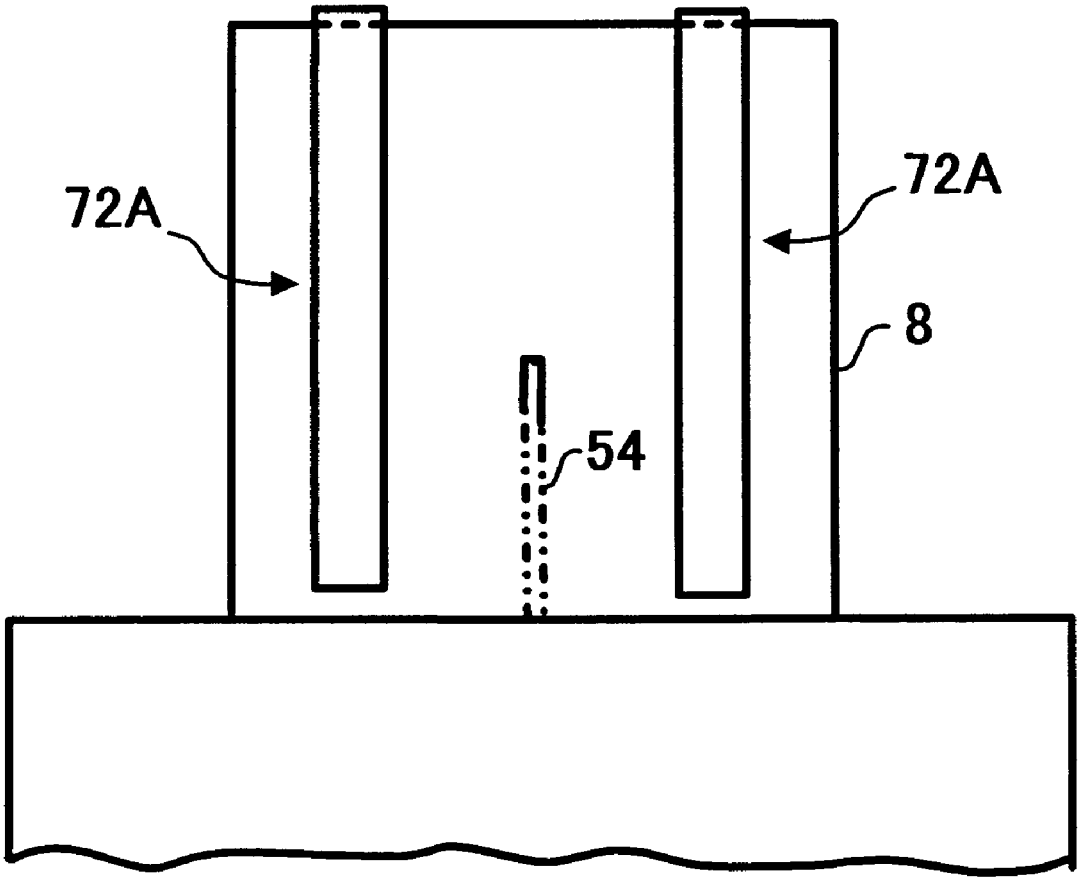
FIG. 6 is a schematic plan view of a sheet tip portion guide device according to the first embodiment of the present invention.

As illustrated in FIG. 6, the sheet tip portion guide device 72A includes a pair of guide plates and is disposed such that the sheet surface detecting lever 54 is positioned in the middle of the pair of guide plates. The sheet tip portion guide device 72A is configured so as to hold and guide both ends of a leading edge of a sheet or a set of sheets in the sheet discharging direction. The distance between the pair of guide plates of the sheet tip portion guide device 72A is set to be shorter than the length of the minimum size sheet in the direction perpendicular to the sheet discharging direction.

Figure 7:
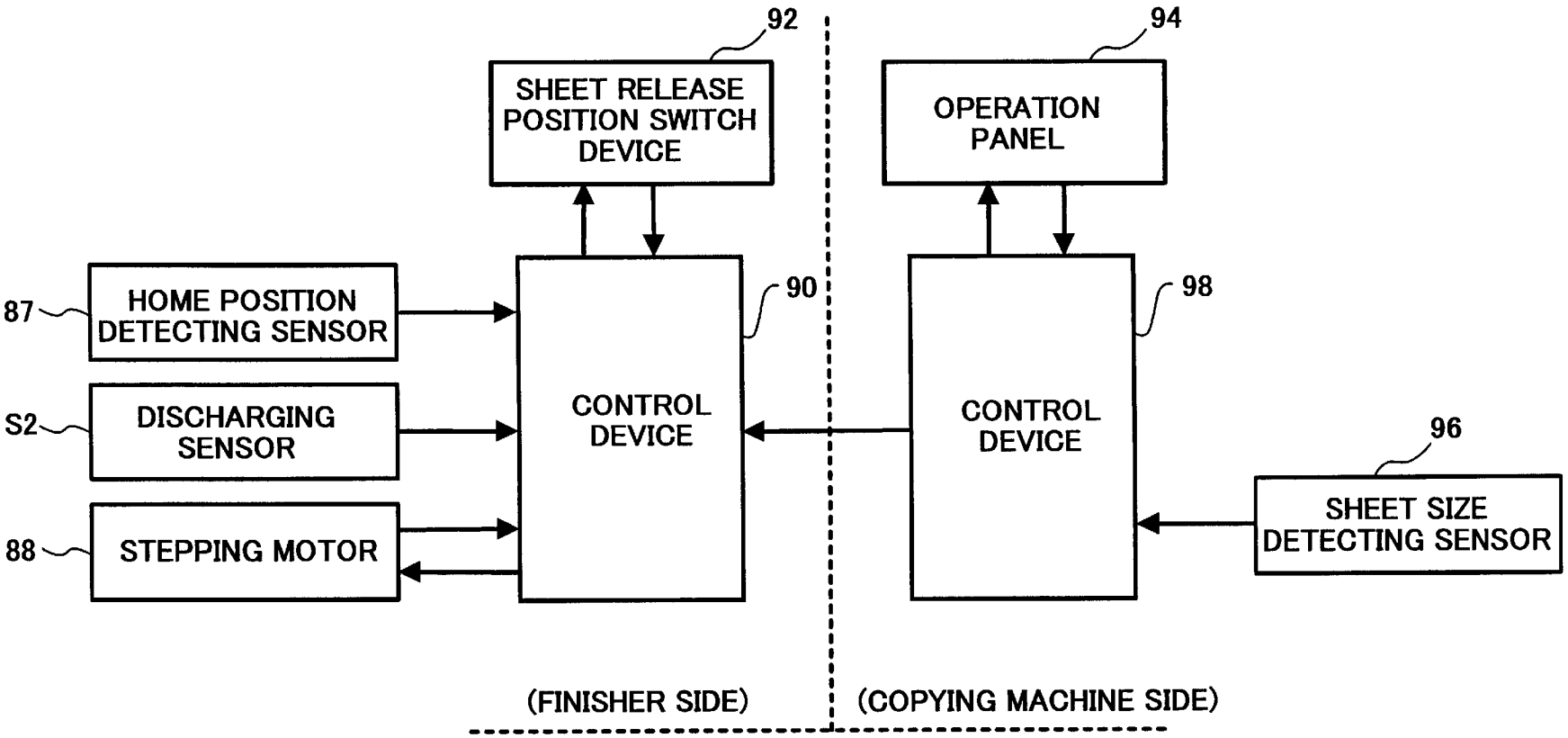
FIG. 7 is a block diagram illustrating configurations of control parts of the finisher and a copying machine for the sheet discharging apparatus of the present invention.

Referring to FIG. 7, a control device 90 including a microcomputer controls the sheet tip portion guide device 72A. Information from each of the home position detecting sensor 87, the discharging sensor S2 and the stepping motor 88 is input to the control device 90.

In the first embodiment of the present invention, there are two sheet release operation modes to release a sheet or a set of sheets held by the holding member 86 depending on a position at which the sheet or sheets are released from the holding member 86. The modes are as follows:

(1) a short distance sheet release mode; and (2) a long distance sheet release mode.

Specifically, in the short distance sheet release mode, the sheet or sheets are released from the holding member 86 by making the moving speed of the holding member 86 faster than the sheet discharging speed of the sheet discharging device 70 after the holding member 86 holds and guides the sheet or sheets through a short distance in the sheet discharging direction. In the long distance sheet release mode, the sheet or sheets are released after the holding member 86 holds and guides the sheet or sheets through a long distance in the sheet discharging direction. The above-described two sheet release operation modes may be selected by manipulating a sheet release position switch device 92 provided to the finisher. When a certain sheet release position is selected with the sheet release position switch device 92, the control device 90 controls the sheet tip portion guide device 72A based on the selected sheet release position. Though it is not shown in figures, the control device 90 is configured to display the selected sheet release operation mode, for example, on an operation panel 94 (illustrated in FIG. 7) provided to the photocopying machine 2.

Referring to FIG. 7, the information of sheet size, which is set by the manipulation of the operation panel 94 of the photocopying machine 2 or which is detected by a sheet size detecting sensor 96 of the photocopying machine 2, is input from a control device 98 of the photocopying machine 2 to the control device 90 of the finisher. The above-described two sheet release operation modes may be selected based on the above-described sheet size information as an alternative to the selection with the sheet release position switch device 92. Specifically, when a small size sheet is set on the operation panel 94 or is detected by the sheet size detecting sensor 96, the control device 90 controls the sheet tip portion guide device 72A to release a sheet or a set of sheets in the short distance sheet release mode, and when a large size sheet is set on the operation panel 94 or is detected by the sheet size detecting sensor 96, the control device 90 controls the sheet tip portion guide device 72A in the long distance sheet release mode.

Next, a guide operation of the sheet tip portion guide device 72A is described. Referring to FIG. 5, when the discharging sensor S2 detects the tip portion of the set of stapled sheets 100, the control device 90 starts to drive the stepping motor 88 so as to move the holding member 86 in the sheet discharging direction after a predetermined time (i.e., when the tip portion of the set of stapled sheets 100 rides on the holding member 86 and is held thereby). At this time, the holding member 86 is controlled to move in the sheet discharging direction at substantially the same speed as the sheet discharging speed of the sheet discharging device 70. Therefore, the tip portion of the set of stapled sheets 100 is guided in the sheet discharging direction, while being held by the holding member 86 (i.e., riding on the holding member 86).

Figure 8:
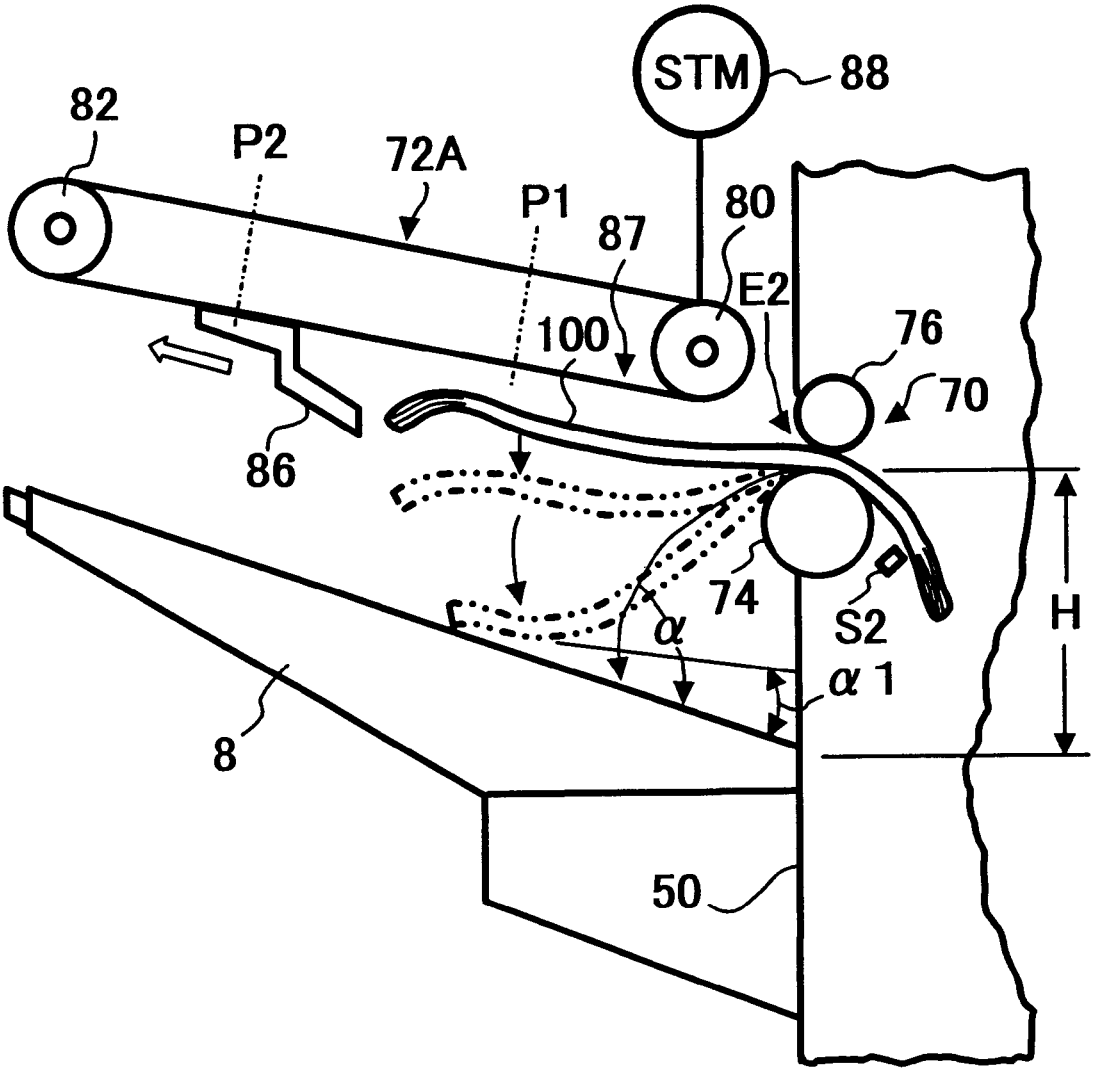
FIG. 8 is a side view illustrating a condition of the sheet discharging apparatus of FIG. 5 when a tip portion of a set of stapled sheets is released.

Referring to FIG. 8, when the short distance sheet release mode is selected with the sheet release position switch device 92, the control device 90 controls to change a stepping signal input to the stepping motor 88 such that the moving speed of the holding member 86 becomes higher than the sheet discharging speed of the sheet discharging device 70, when the holding member 86 reaches a position P1. As a result, the holding member 86 releases the tip portion of the set of stapled sheets 100 and thereby the set of stapled sheets 100 is left behind, and the tip portion of the set of stapled sheets 100 falls down to the surface of the sheet discharging tray 8. Because the tip portion of the set of stapled sheets 100 falls down to the surface of the sheet discharging tray 8 after having been guided through a certain distance, an angle ($\alpha$) formed between the stapled sheets 100 and the surface of the sheet discharging tray 8 at the contact point of the tip portion of the stapled sheets 100 with the surface of the sheet discharging tray 8 becomes much smaller than the angle ($\alpha$) which is formed when the set of stapled sheets 100 falls down to the surface of the sheet discharging tray 8 immediately after having been discharged from the sheet discharging device 70 as in the background sheet discharging apparatus. Thereby, the bending of the tip portion of the stapled sheets 100 is avoided. The longer the holding member 86 guides the tip portion of the stapled sheets 100, the smaller the above-described angle ($\alpha$) becomes. The control device 90 controls the position P1 by counting the step number of the stepping motor 88. After the holding member 86 releases the tip portion of the stapled sheets 100, the control device 90 reverses the stepping motor 88, and thereby the holding member 86 returns to the home position to wait for the next set of stapled sheets discharged from the sheet discharging device 70.

Because the moving speed of the holding member 86 and the sheet discharging speed of the sheet discharging device 70 are substantially the same until the tip portion of the stapled sheets 100 is released from the holding member 86, the holding member 86 may hold the tip portion of the stapled sheets 100 on the surface of the holding member 86. Therefore, the holding part of the holding member 86 has an L-shaped form and its flat part is formed in a slightly downward slanting condition looking from the side so that the holding member 86 can smoothly release the tip portion of the stapled sheets 100.

When the long distance sheet release mode is selected with the sheet release position switch device 92, the control device 90 controls the stepping motor 88 such that the moving speed of the holding member 86 becomes higher than the sheet discharging speed of the sheet discharging device 70 when the holding member 86 arrives at a position P2. Even when a sheet is long and curled downward, bending of the sheet is surely avoided with the above long distance sheet release mode.

If the long and curled sheet is discharged in the short distance sheet release mode, the tip portion of the long sheet is pushed up along the surface of the sheet discharging tray 8 after falling down to the sheet discharging tray 8 until the end portion of the sheet is discharged completely, and the tip portion of the sheet may be bent while being pushed up.

If a sheet is not prone to be curled strongly by the finisher and the sheet is discharged adequately without being bent even when the sheet is long, the short distance sheet release mode may be sufficient in the sheet discharging apparatus. This is because the sheet may be pushed up along the surface of the sheet discharging tray 8 after falling down to the sheet discharging tray 8 until the end portion of the sheet is discharged completely. Therefore, the length of the sheet tip portion guide device 72A in the sheet discharging direction may be short, and accordingly the sheet tip portion guide device 72A may be made compact.

When the holding member 86 moves a distance longer than the length of the set of stapled sheets 100 in the sheet discharging direction, the tail end of stapled sheets 100 falls down from the sheet discharging device 70 to the sheet discharging tray 8 after the tail end of the stapled sheets 100 passes through the nip portion of the discharging rollers 74 and 76. Therefore, the tip portion of stapled sheets 100 is released from the holding member 86 in due course without speeding up the movement of the holding member 86. However, speeding up the movement of the holding member 86 enables the holding member 86 to return to the home position at a relatively short interval. Accordingly, a sheet discharging interval of the sheet discharging device 70 for the set of stapled sheets 100 can be made shorter.

The above-described configuration of the sheet discharging apparatus according to the first embodiment of the present invention is particularly effective in preventing the sheet tip bending problem when the sheet discharging tray 8 is fixed and does not move up and down and when a distance H between the discharging exit E2 and the surface of the sheet discharging tray 8 is relatively long. This is because the angle between the stapled sheets 100 discharged from the sheet discharging device 70 and the surface of the sheet discharging tray 8 at the contact point between the tip portion of the stapled sheets 100 and the surface of the sheet discharging tray 8 becomes greater as the distance H becomes longer, and thereby the tip of the stapled sheets 100 is prone to be bent.

Though the stepping motor 88 is used as a separate driving source for the sheet tip portion guide device 72A in the first embodiment of the present invention, other separate driving sources may be used or a driving source for the finisher may be used via a clutch or the like.

Figure 9:
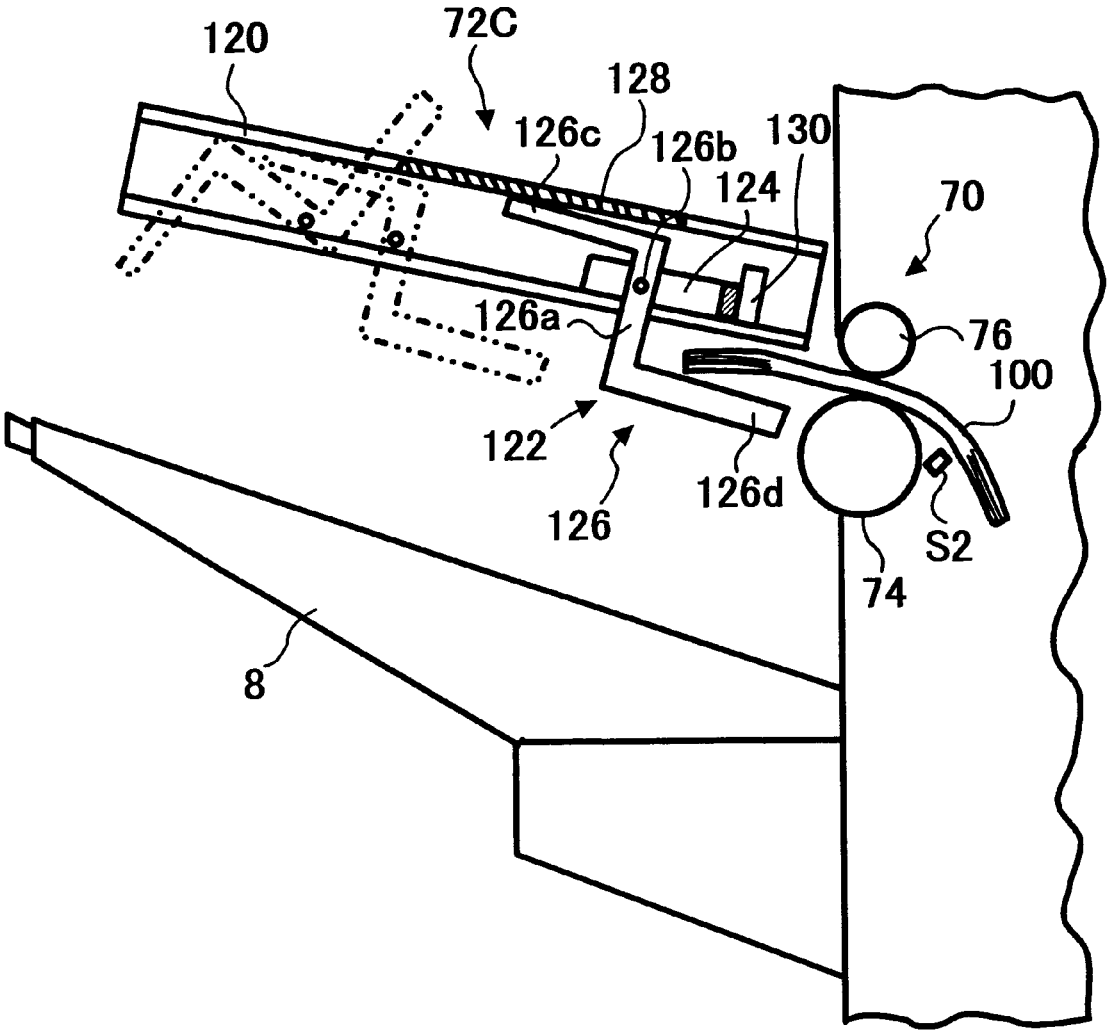
FIG. 9 is a side view illustrating a sheet discharging apparatus according to a second embodiment of the present invention.
Figure 10:
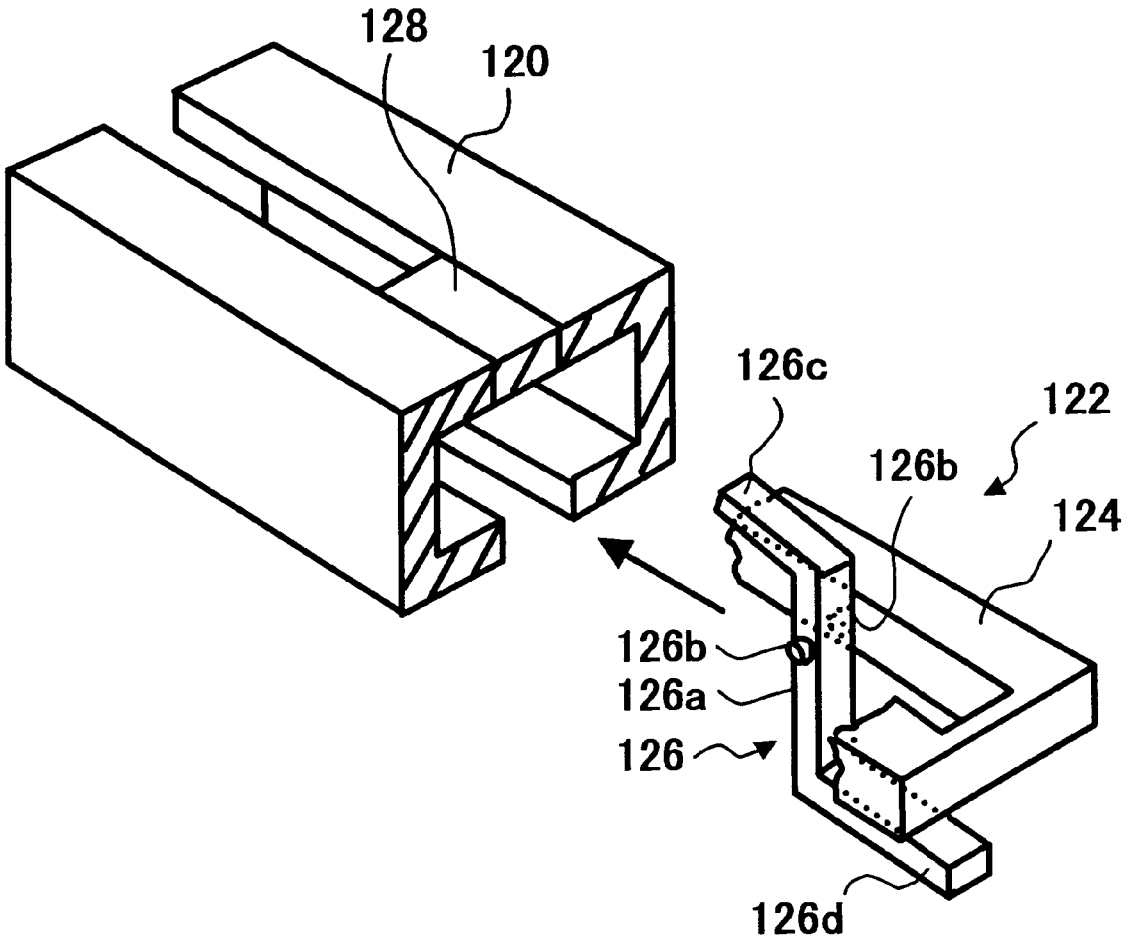
FIG. 10 is a perspective view illustrating a main part of a sheet tip portion guide device of the sheet discharging apparatus of FIG. 9.

Next, a sheet discharging apparatus according to a second embodiment of the present invention is described referring to FIGS. 9 and 10. For the sake of clarity, the members having substantially the same functions as the ones used in the above-described first embodiment will be designated with the same code and their description will be omitted.

A sheet tip portion guide device 72C of the second embodiment has a different configuration from that of the sheet tip portion guide device 72A of the first embodiment. The characteristic of the sheet tip portion guide device 72C is that a driving source is not required to drive the holding member. Rather, the holding member moves by a pushing force of the discharged sheet or sheets.

Referring to FIG. 9, the sheet tip portion guide device 72C includes a rail member 120 which is fixed slantwise to the finisher via brackets (not shown), and a holding member 122 which moves through the rail member 120.

As illustrated in FIG. 10, the holding member 122 includes a rectangular U-shaped slider 124 which slides along the inside of the rail member 120, and a Z-shaped holding section 126 which is swingably supported by the slider 124. Provided on both sides of a vertical portion 126*a* of the holding section 126 are convex portions 126*b*. The holding section 126 is supported by the slider 124 by engaging the convex portions 126*b* with holes formed in the slider 124.

Referring further to FIG. 10, the rail member 120 is formed by a pair of channel members. Between upper parts of the pair of channel members, a plate cam 128 is sandwiched and is fixed to the channel members as a swing regulation member to regulate swings of the holding section 126. Further, as illustrated in FIG. 9, a stopper 130 is formed at the upstream end of the rail member 120 in the sheet discharging direction to position the holding member 122 at a home position.

When the holding member 122 is located at the home position as illustrated by a solid line in FIG. 9, an upper flat portion 126*c* of the holding section 126 abuts against the plate cam 128, and thereby the holding section 126 cannot swing. When the set of stapled sheets 100 is discharged from the sheet discharging device 70 and the tip portion of the stapled sheets 100 rides on a lower flat portion 126*d* of the holding section 126 while the holding member 122 is located at the home position, the holding member 122 moves by being pushed by the tip portion of the stapled sheets 100 due to the friction between the tip portion of the stapled sheets 100 and the surface of lower flat portion 126*d* of the holding section 126. If the frictional force between the lower flat portion 126*d* of the holding section 126 and the tip portion of the stapled sheets 100 is relatively small, the holding member 122 starts to move when the tip portion of the stapled sheets 100 abuts against the vertical portion 126*a* of the holding section 126.

First, the holding member 122 moves at substantially the same speed as the sheet discharging speed of the set of stapled sheets 100. When the holding section 126 pushed by the stapled sheets 100 reaches the position in which the plate cam 128 does not regulate the holding section 126, the holding section 126 swings in the clockwise direction as illustrated by a two-dots-and-dash line in FIG. 9. Thereby, the tip portion of the set of stapled sheets 100 is released from the holding section 126, and falls to the surface of the sheet discharging tray 8. Thus, a relatively small angle is formed between the stapled sheets 100 and the surface of the sheet discharging tray 8 at the contact point between the tip portion of the stapled sheets 100 and the surface of the sheet discharging tray 8. Thus, the stapled sheets 100 are discharged on the sheet discharging tray 8 without being bent.

The holding section 126 is formed such that the lower flat portion 126*d* side is heavier than the upper flat portion 126*c* side. Therefore, immediately after releasing the tip portion of the set of stapled sheets 100, the holding section 126 swings back in the counterclockwise direction to the original position due to the weight balance between the lower flat portion 126*d* side and the upper flat portion 126*c* side. At the same time, the holding member 122 returns to the home position by its gravity, moving through the slant rail member 120.

The above-described sheet release position of the holding member 122 can be changed by changing the length of the plate cam 128 in the sheet discharging direction.

In the second embodiment of the present invention, a driving source for moving the holding member 122 is not required, and therefore a driving control operation is not necessary. Thus, according to the second embodiment of the present invention, a sheet discharging apparatus capable of avoiding a bending of a sheet or sheets can be achieved at a relatively low cost.

Figure 11:
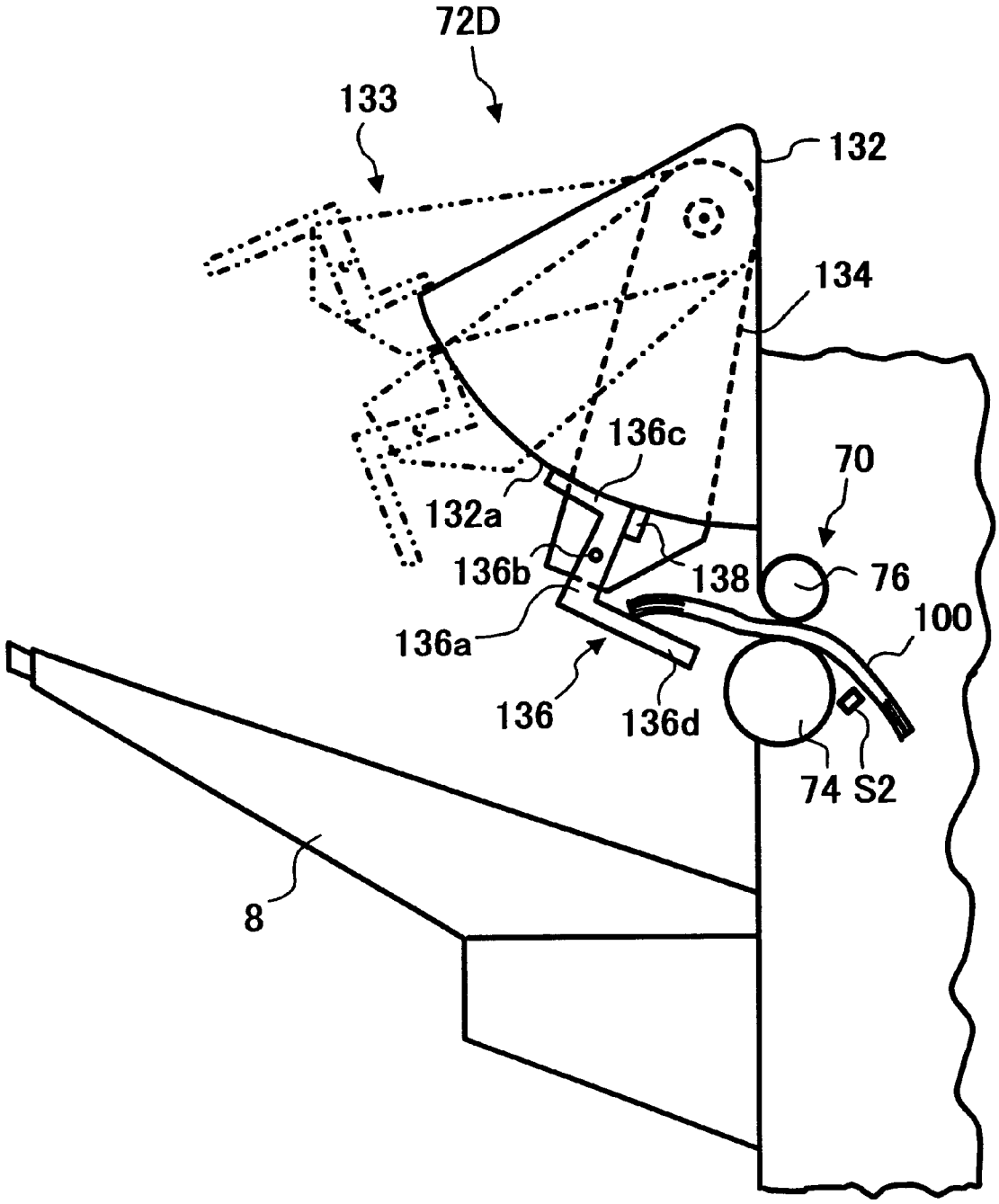
FIG. 11 is a side view illustrating a sheet discharging apparatus according to a third embodiment of the present invention.

Referring to FIG. 11, another sheet discharging apparatus according to a third embodiment, which also does not require a driving source for a holding member is described.

A sheet tip portion guide device 72D according to the third embodiment includes a sector-shaped rail member 132 which is fixed to the finisher to serve as a swing regulation member and a holding member 133 to hold discharged sheets.

The holding member 133 includes an arm 134 whose upper end part is swingably supported by the rail member 132, and a Z-shaped holding section 136 which is swingably supported by a lower end part of the arm 134 via a shaft 136*b*. On a rail surface 132*a* of the rail member 132, a stopper 138 is provided to position the holding member 133 at a home position.

When the holding member 133 is located at the home position as illustrated by a solid line in FIG. 11, the holding section 136 cannot swing due to the regulation by the rail surface 132*a*. When the set of stapled sheets 100 is discharged from the sheet discharging device 70 and the tip portion of the stapled sheets 100 rides on a lower flat portion 136*d* of the holding section 136 while the holding member 133 is located at the home position, the holding member 133 is pushed by the tip portion of the set of stapled sheets 100 due to the friction between the tip portion of the stapled sheets 100 and the surface of the lower flat portion 136*d*. When the frictional force between the lower flat portion 136*d* and the tip portion of the stapled sheets 100 is relatively small, the holding member 133 starts to move when the tip portion of the stapled sheets 100 abuts against the vertical portion 136*a* of the holding section 136.

Because the rail member 132 is sector-shaped and the rail surface 132*a* is curved upward in the sheet discharging direction, as the sheet or sheets push the holding section 136 of the holding member 133, the holding member 133 is displaced upward. Thereby, the holding section 136 changes its posture to a posture in which the tip portion of the sheet or sheets can be easily released from the holding section 136.

In the sheet discharging apparatus according to the third embodiment of the present invention, the tip portion of the sheet or sheets can be released from the holding section 136 at a shorter distance in the horizontal direction and more easily than the sheet discharging apparatus in the second embodiment When the holding section 136 reaches a position in which the holding section 136 is not regulated by the rail surface 132*a* as indicated by a two-dots-and-dash line in FIG. 11, the holding section 136 starts to rotate. Thereby, the tip portion of the set of stapled sheets 100 is released from the holding section 136 and falls to the surface of the sheet discharging tray 8 forming a relatively small angle between the stapled sheets 100 and the surface of the sheet discharging tray 8 at the contact point between the tip portion of the stapled sheets 100 and the surface of the sheet discharging tray 8. Thus, the stapled sheets 100 are discharged on the sheet discharging tray 8 without being bent.

Like the second embodiment of the present invention, the holding section 136 is formed such that the lower flat portion 136*d* side is heavier than the upper flat portion 136*c* side. Therefore, immediately after releasing the tip portion of the set of stapled sheets 100, the holding section 136 swings back in the counterclockwise direction to the original position due to the weight balance between the lower flat portion 136*d* side and the upper flat portion 136*c* side. At the same time, the holding member 133 returns to the home position by its gravity.

Figure 12:
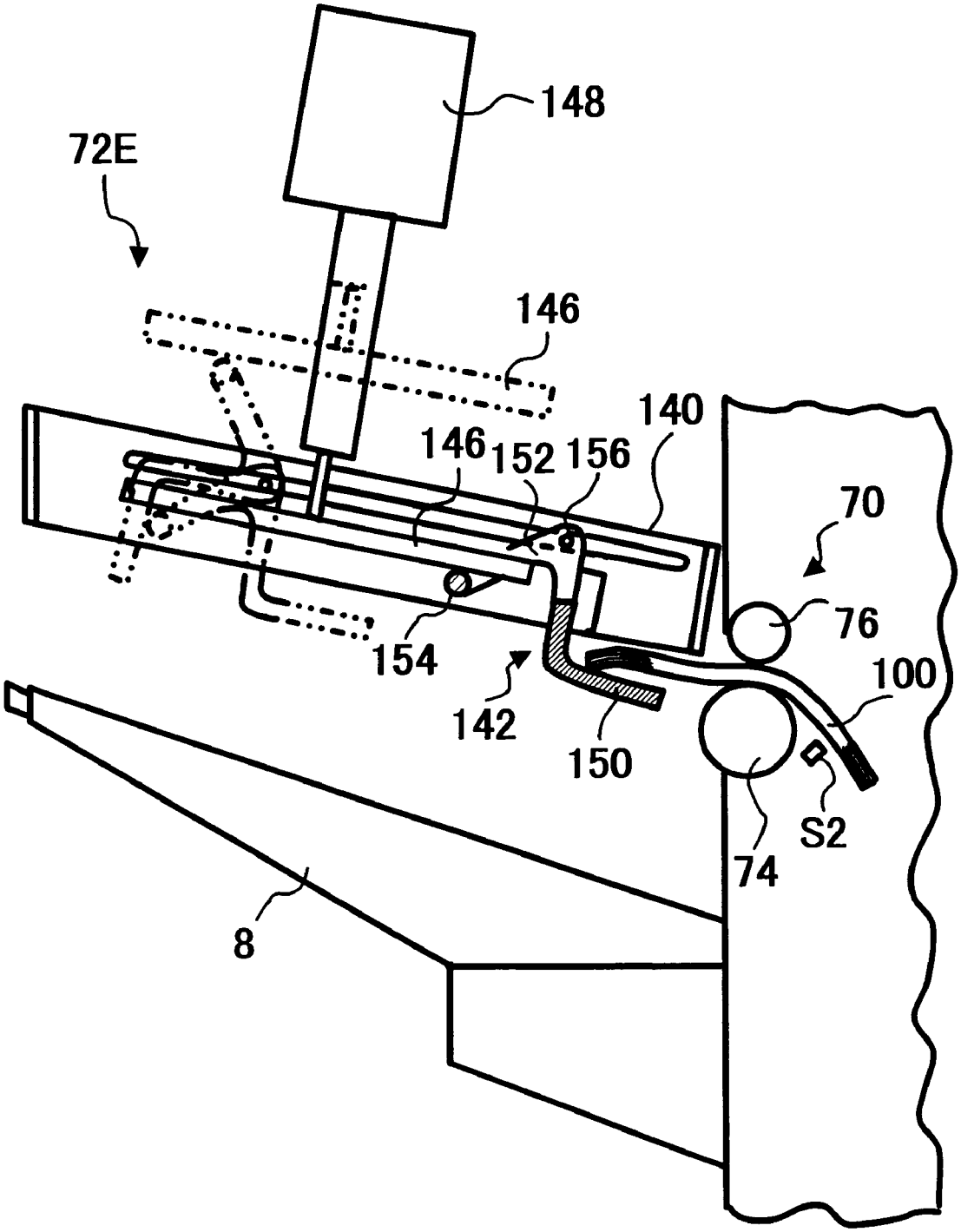
FIG. 12 is a side view illustrating a sheet discharging apparatus according to a fourth embodiment of the present invention.
Figure 13:
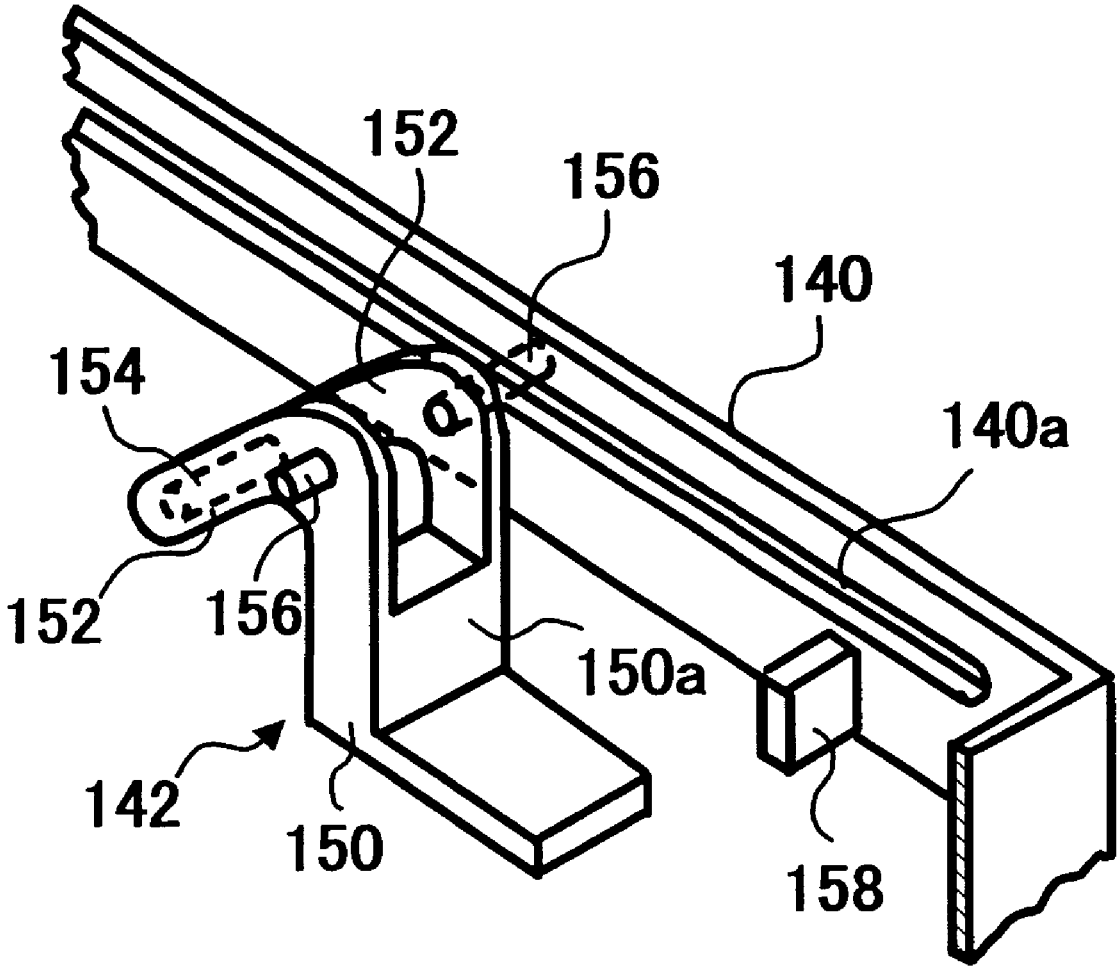
FIG. 13 is a perspective view illustrating a main part of a sheet tip portion guide device of the sheet discharging apparatus of FIG. 12.

A fourth embodiment of the present invention is now described referring to FIGS. 12 and 13. For the sake of clarity, the members having substantially the same functions as the ones used in the above-described embodiments will be designated with the same code and their description will be omitted.

The characteristics of a sheet discharging apparatus of the fourth embodiment are that it has no driving source to drive a holding member to hold discharged sheets and that it can set a sheet release position for the holding member at arbitrary positions.

Referring to FIG. 12, a sheet tip portion guide device 72E includes a rail member 140 which is fixed slantwise to the finisher via brackets (not shown), a holding member 142 which moves through the rail member 140, a bar 146 as a swing regulation member to regulate swings of the holding member 142, and a solenoid 148 serving as a displacing device for the swing regulation member which enables the holding member 142 to swing at an arbitrary position in the sheet discharging direction.

As illustrated in FIG. 13, the holding member 142 includes an L-shaped holding section 150, a pair of arms 152 which extend upward from both upper ends of the holding section 150 and then curve downward slantwise and face each other, and a cylindrically shaped abutment portion 154 which extends between the tip portions of the pair of arms 152.

At the curved portions of the pair of arms 152, a shaft 156 is passed through the pair of arms 152. The shaft 156 is engaged with a rail groove 140*a* of the rail member 140, and thereby the holding member 142 is swingably supported by the rail member 140. Further, a stopper 158 is formed at the upstream end of the rail member 140 in the sheet discharging direction to position the holding member 142 at a home position.

When the holding member 142 is located at the home position as illustrated by a solid line in FIG. 12, the solenoid 148 is turned off, and the bar 146 is positioned within the rail member 140 and abuts against the abutment portion 154 of the holding member 142 as illustrated by a solid line in FIG. 12. Thereby, the holding member 142 cannot swing. When the set of stapled sheets 100 is discharged from the sheet discharging device 70 and the tip portion of the stapled sheets 100 rides on the holding section 150 while the holding member 142 is located at the home position, the holding member 142 is pushed by the stapled sheets 100 due to the friction between the tip portion of the stapled sheets 100 and the surface of the holding section 150. If the frictional force between the holding section 150 and the tip portion of the stapled sheets 100 is relatively small, the holding member 142 starts to move when the tip portion of the stapled sheets 100 abuts against a vertical portion 150*a* (illustrated in FIG. 13) of the holding section 150.

The holding member 142 first moves at substantially the same speed as the sheet discharging speed of the set of stapled sheets 100. When the solenoid 148 is turned on and the bar 146 is pulled up from the rail member 140 at a predetermined position, the abutment portion 154 becomes free from the regulation by the bar 146. Therefore, the holding member 142 swings in the clockwise direction by being pushed by the set of stapled sheets 100 as illustrated by a two-dots-and-dash line in FIG. 12. Thereby, the tip portion of the set of stapled sheets 100 is released from the holding section 150 and falls down on the surface of the sheet discharging tray 8 forming a relatively small angle between the stapled sheets 100 and the surface of the sheet discharging tray 8 at the contact point between the tip portion of the stapled sheets 100 and the surface of the sheet discharging tray 8. Thus, the stapled sheets 100 are discharged on the sheet discharging tray 8 without being bent.

The holding member 142 is formed such that the holding section 150 side is heavier than the arms 152 side. Therefore, immediately after releasing the tip portion of the set of stapled sheets 100, the holding member 142 swings back in the counterclockwise direction to the original position due to the weight balance between the holding section 150 side and the arms 152 side. At the same time, the holding member 142 returns to the home position by its gravity, moving along the slant rail groove 140*a*.

In the fourth embodiment of the present invention, a sheet release position can be set at arbitrary positions by controlling a timing to turn on and off the solenoid 148. Like the first embodiment of the present invention, the sheet discharging apparatus can be configured such that a sheet release position is switched among a plurality of sheet release positions by the sheet release position switch device. Like the other embodiments described above, a bending of a tip portion of a sheet can be prevented in the fourth embodiment.

Figure 14:
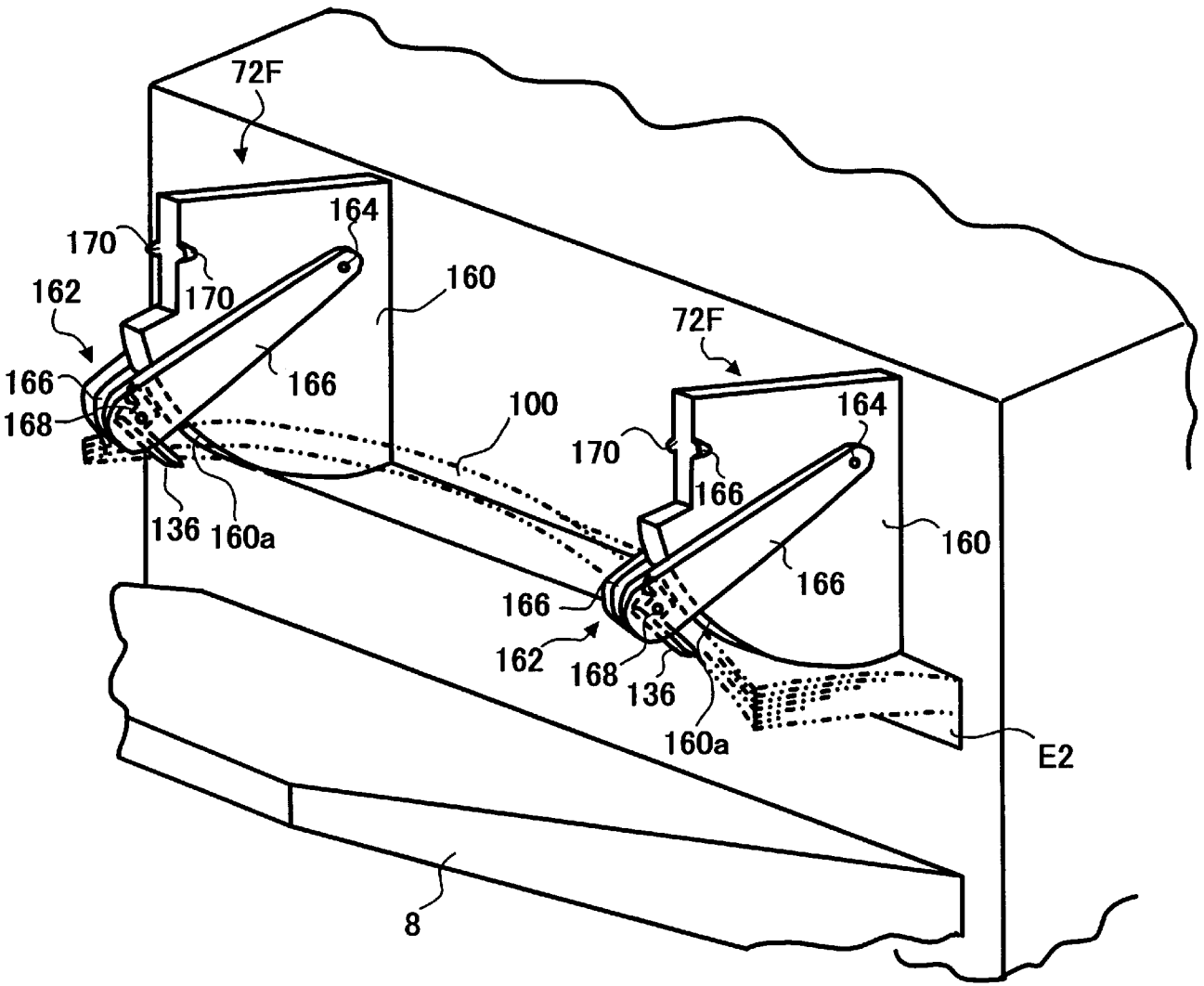
FIG. 14 is a perspective view illustrating a sheet discharging apparatus according to a fifth embodiment of the present invention.

A sheet discharging apparatus according to a fifth embodiment of the present invention is next described referring to FIG. 14. For the sake of clarity, the members having substantially the same functions as the ones used in the above-described embodiments will be designated with the same code and their description will be omitted.

The sheet discharging apparatus of the fifth embodiment is modified from the one in the third embodiment of the present invention.

A sheet tip portion guide device 72F according to the fifth embodiment includes a sector-shaped rail member 160 as a swing regulation member, which is fixed on the finisher, and a holding member 162 to hold discharged sheets.

The holding member 162 includes a pair of arms 166 whose upper end portions are rotatively supported by the rail member 160 via a shaft 164, and a Z-shaped holding section 136 which is swingably supported by lower end portions of the pair of arms 166 via a shaft 168. Though a stopper is provided on the rail member 160, the description and illustration of the stopper are omitted.

At an end portion of a rail surface 160*a* of the rail member 160, a pair of convex portions 170 is integrally formed with the rail member 160 such that the pair of convex portions 170 protrudes in the direction of the thickness of the rail member 160. The pair of convex portions 170 serves as a catch device to catch the holding member 162 at the position in which the holding member 162 does not interfere with the discharged sheet.

When a thin sheet having weak tension is discharged, the holding member 162 may not be able to guide the thin sheet due to lack of pushing force of the thin sheet, and thus the holding member 162 may interfere with the discharge of the thin sheet. Therefore, when sheets are thin, in order to avoid the interference of the holding member 162 with the thin sheets, the holding member 162 is moved in advance so as to be caught by the pair of convex portions 170 at the position in which the holding member 162 does not interfere with discharged sheets.

Figure 16:
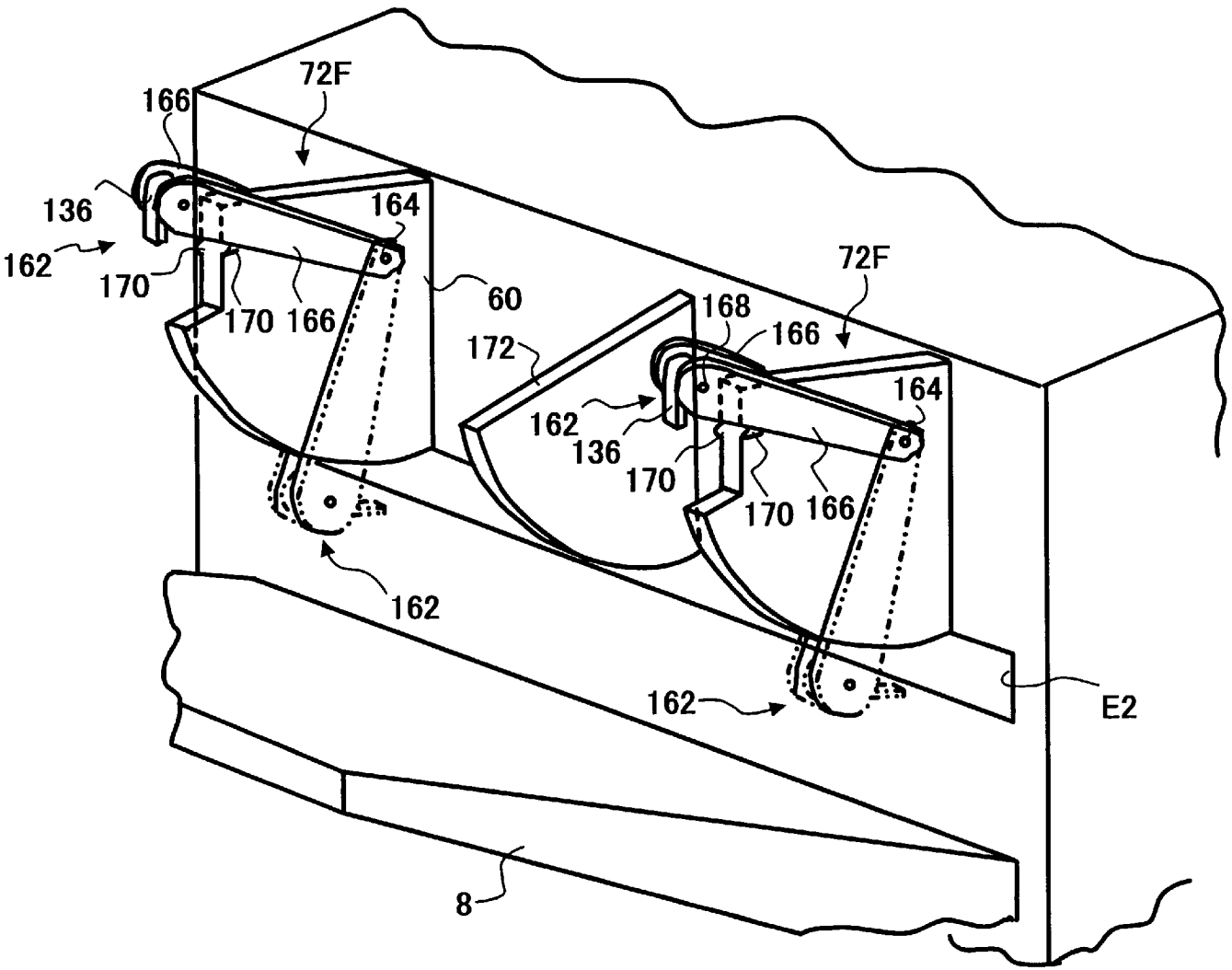
FIG. 16 is a perspective view illustrating a condition of the sheet discharging apparatus of FIG. 15, when a holding member is caught at a position in which the holding member does not interfere with a discharged sheet or sheets.

Specifically, when an operator swings the holding member 162 upward, the top ends of the pair of arms 166 abut against the pair of convex portions 170. When the operator further pulls up the holding member 162 strongly, the pair of arms 166 passes over the pair of convex portions 170 because the arms 166 are made of elastic and flexible materials, and is then held by the convex portions 170 with their lower ends caught by the pair of convex portions 170 as illustrated by a solid line in FIG. 16. When the operator needs to return the holding member 162 to the original position, the pair of arms 166 can be moved by pulling down strongly enough to pass over the pair of convex portions 170 in the opposite manner.

As illustrated in FIG. 14, the sheet tip portion guide device 72F is provided to guide a sheet or a set of sheets discharged from a discharging exit E2 with both ends of the leading edge of the sheet or sheets held by the holding member 162. However, when a set of sheets 100 is stapled a central part of the stapled sheets 100 may bulge upward due to stapling when such stapled sheets 100 are discharged. The bulged central part of the stapled sheets 100 may contact an upper edge of the discharging exit E2, and thereby the stapled sheets 100 may be caught due to the friction between the stapled sheets 100 and the upper edge of the discharging exit E2. As a result, the set of stapled sheets 100 may not be discharged adequately.

Figure 15:
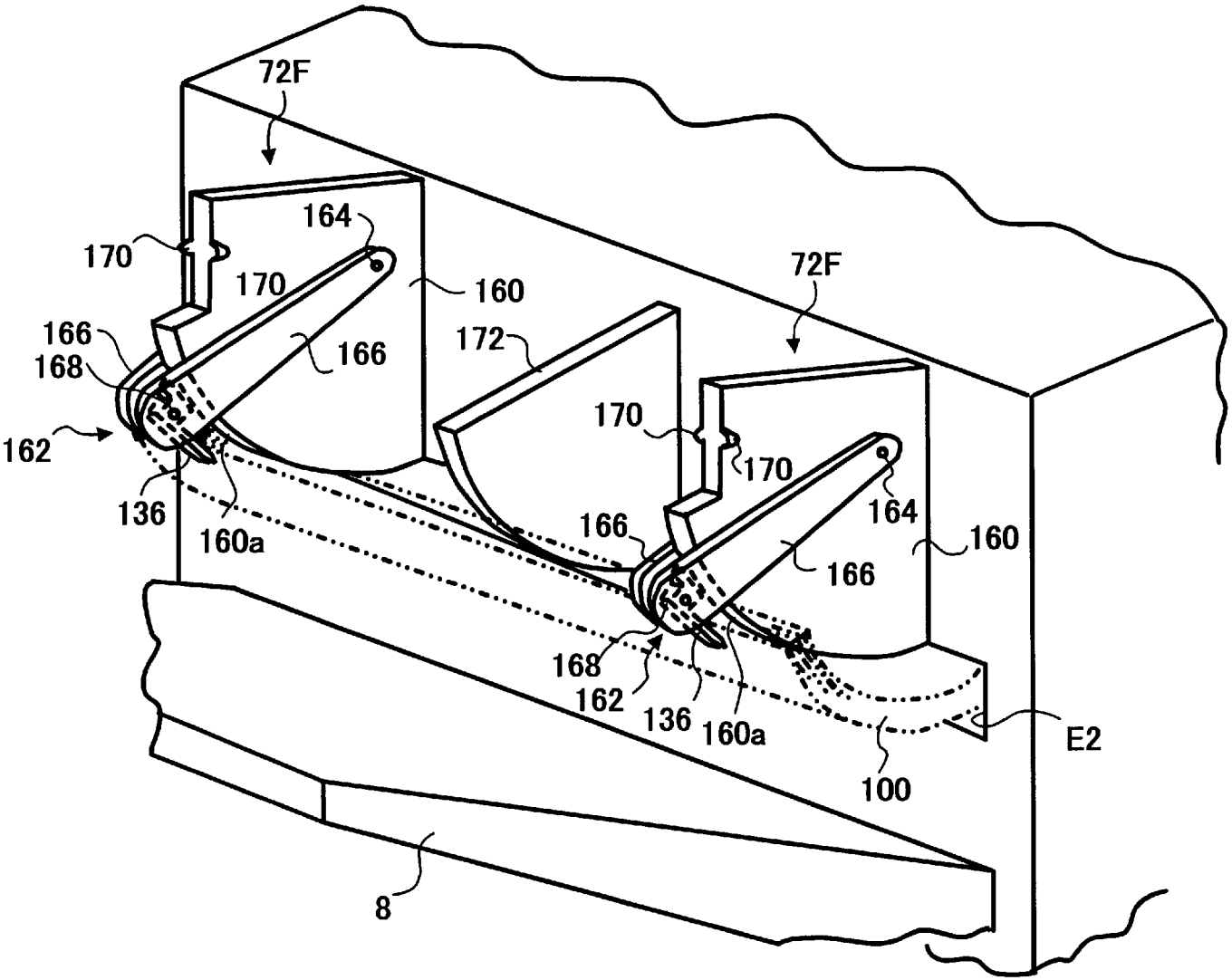
FIG. 15 is a perspective view illustrating a modification of the sheet discharging apparatus of FIG. 14.

In order to avoid the above-described inadequate discharge of the stapled sheets 100, as illustrated in FIG. 15, a sheet correction member 172 is provided in the vicinity of the sheet discharging device 70 (not shown in FIG. 15) so as to regulate the bulge of the sheet or sheets at substantially the central part of the sheet or sheets in the direction perpendicular to the sheet discharging direction.

The shape of the sheet correction member 172 is not limited to the one illustrated in FIG. 15, and the sheet correction member 172 may be formed in any shape suitable for suppressing a bulge at a central part of the sheet or sheets in the direction perpendicular to the sheet discharging direction. In this embodiment, the shape of the sheet correction member 172 is made similar to the sector portion of the rail member 160 so as to make the sheet discharging speed at the central part of the sheets the same as those of the pair of rail members 160 and discharge the sheet or sheets smoothly. Alternatively, an additional sheet tip portion guide device 72F may be provided at the central part of the discharging exit E2 as the sheet correction member 172.

The above-described catch device, such as the convex portions 170, may also be provided to the rail member 132 in FIG. 11 of the third embodiment of the present invention. Moreover, the above-described sheet correction member 172 may be also applicable to each sheet discharging apparatus according to the first through fourth embodiments of the present invention.

A sixth embodiment of the present invention is described referring to FIGS. 17 through 22. A characteristic of the sixth embodiment is that a shift of the holding member 162 between a sheet guide position and a position in which the holding member 162 does not interfere with the discharged sheet is made automatically as an alternative to the manual shift by an operator according to the sheet type, which is described in the fifth embodiment.

For the sake of clarity, the members having substantially the same functions as the ones used in the above-described embodiments will be designated with the same code and their description will be omitted.

Figure 17:
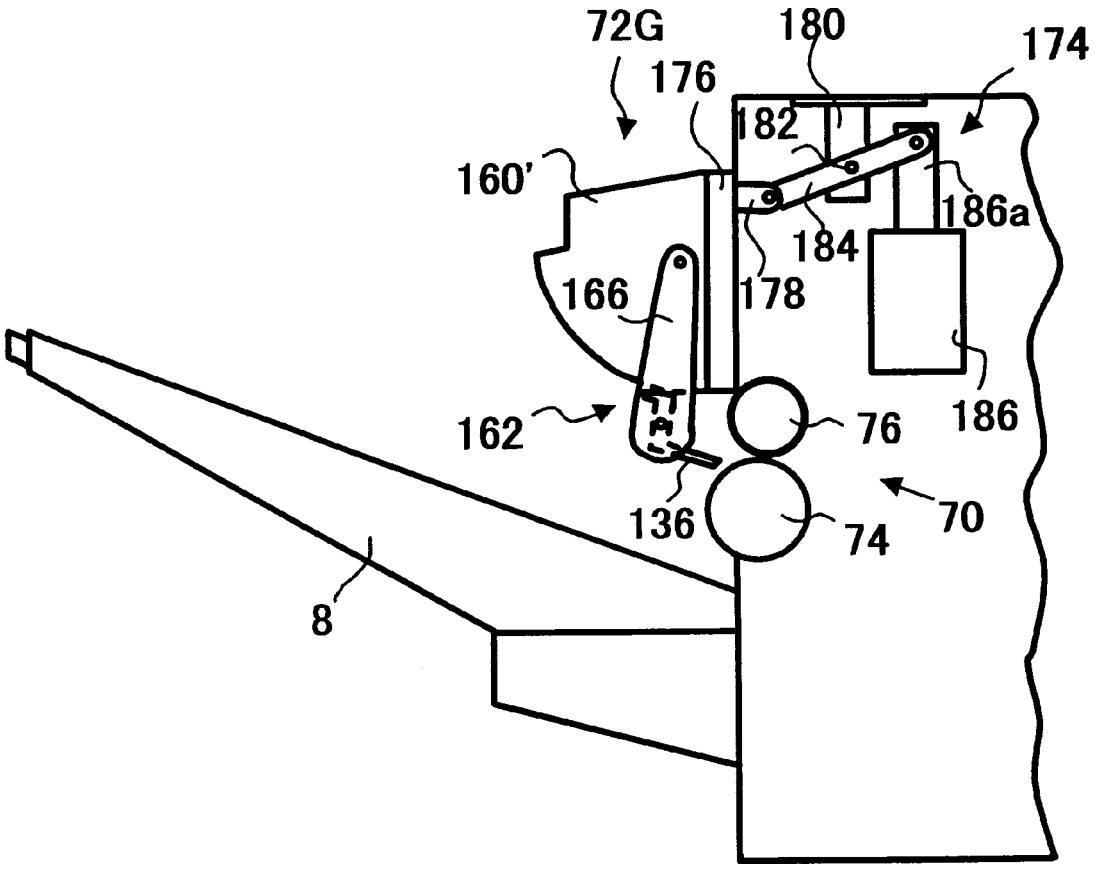
FIG. 17 is a side view illustrating a sheet discharging apparatus according to a sixth embodiment of the present invention.

As illustrated in FIG. 17, a sheet tip portion guide device 72G includes a sector-shaped rail member 160', which does not have the pair of convex portions 170 described in the fifth embodiment, and the holding member 162 which is guided by the rail member 160'. The sheet tip portion guide device 72G is configured to be shifted by a shifting device 174 to an arbitrary position in which the sheet tip portion guide device 72G does not interfere with a sheet or sheets.

The shifting device 174 is provided to the finisher such that the shifting device 174 can slide up and down by a guide member (not shown). The shifting device 174 includes a slide base 176 to which the rail member 160' is fixed, a bracket 178 which is fixed to the slide base 176, an arm 184 which is rotatively supported at a central part thereof as a fulcrum by a bracket 180, which is fixed to the finisher via a shaft 182, and a solenoid 186. One end of the arm 184 is rotatively connected to the bracket 178, and another end is rotatively connected to a tip portion of a movable rod 186*a* of the solenoid 186.

Figure 18:
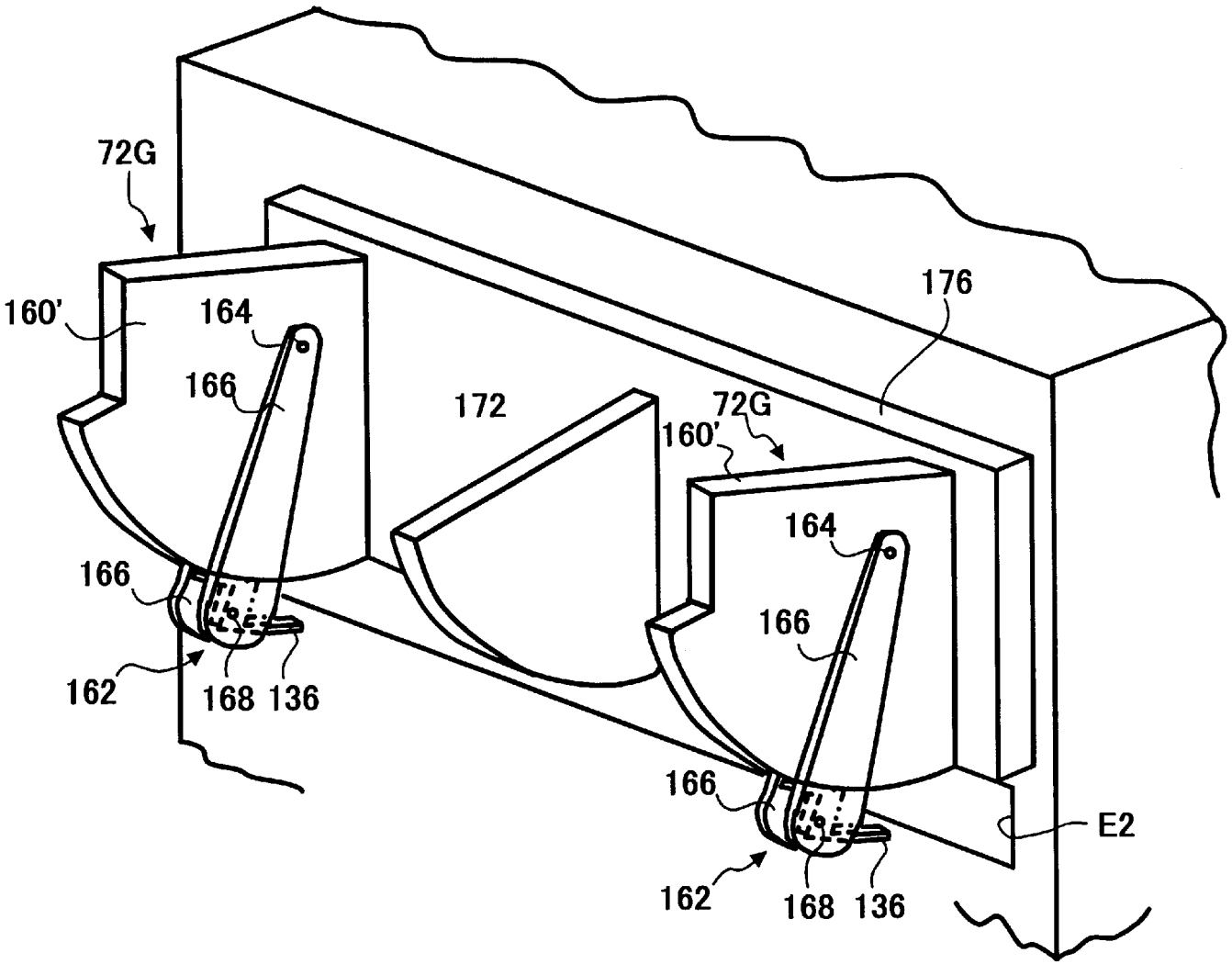
FIG. 18 is a perspective view illustrating a condition of the sheet discharging apparatus of FIG. 17, when a sheet tip portion guide device is positioned at a sheet guide position.

FIG. 17 illustrates a condition of the sheet discharging apparatus where the solenoid 186 is turned off and the sheet tip portion guide device 72G is ready to hold and guide a sheet or sheets discharged from the sheet discharging device 70, which is also illustrated in FIG. 18.

Figure 19:
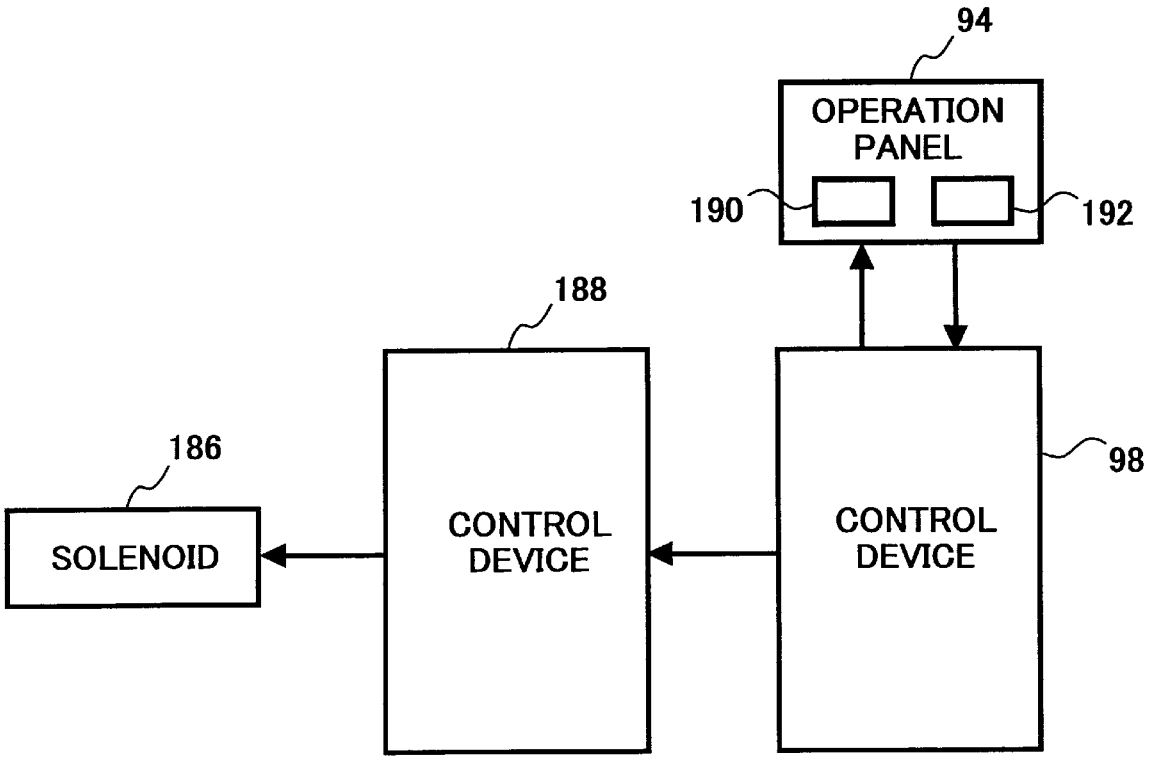
FIG. 19 is a block diagram illustrating configurations of control parts of the finisher and the copying machine for the sheet discharging apparatus of FIG. 17.

As illustrated in FIG. 19, the solenoid 186 is configured to be controlled by a control device 188. On an operation panel 94 of the copying machine, an input device 190 (i.e., a switch) is provided to selectively turn on and off the solenoid 186. The control device 188 includes a microcomputer including a central processing unit (CPU), a random access memory (RAM), a read-only memory (ROM), and the like.

Figure 20:
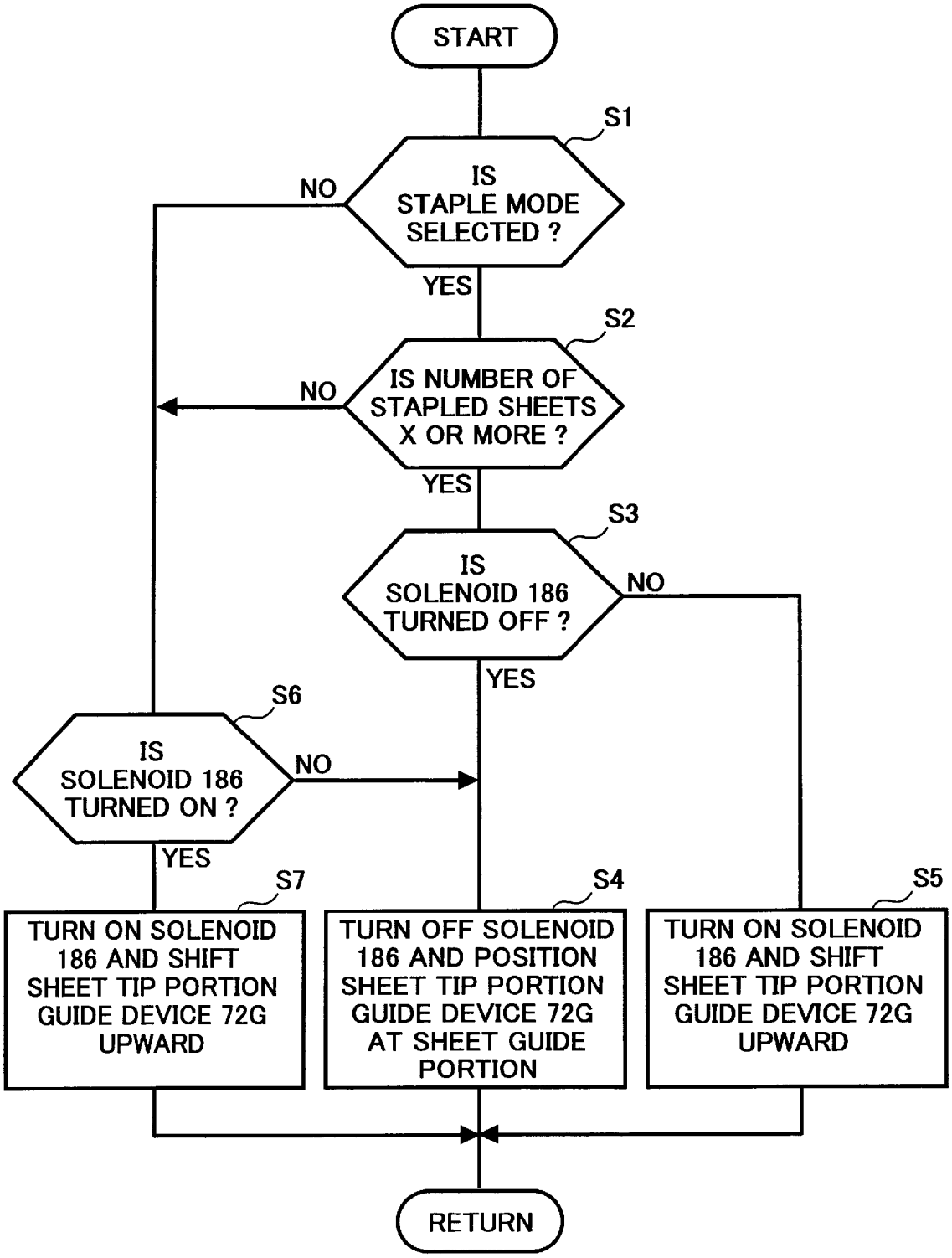
FIG. 20 is a flowchart illustrating steps of a control operation according to the sixth embodiment of the present invention.
Figure 21:
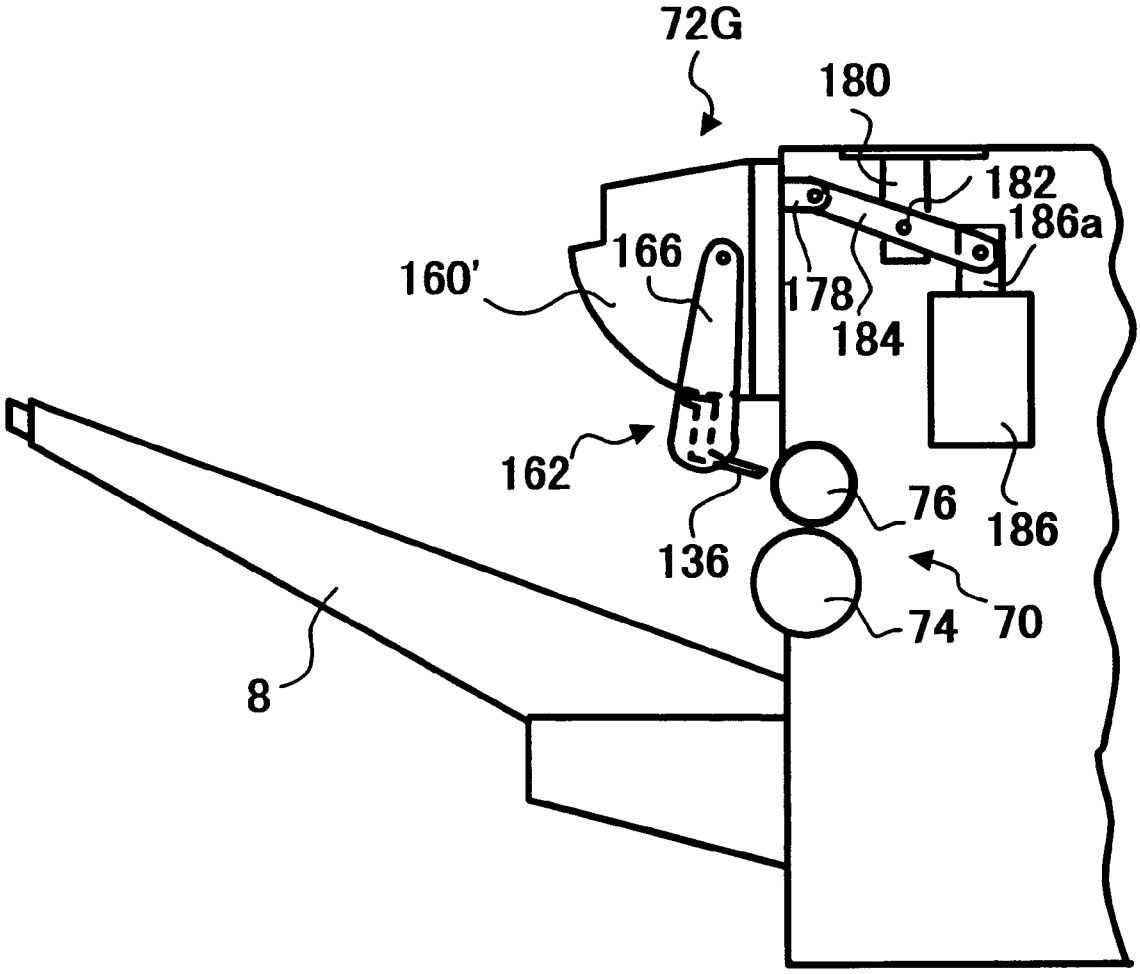
FIG. 21 is a side view illustrating a condition of the sheet discharging apparatus of FIG. 17, when the sheet tip portion guide device is positioned at a position in which the sheet tip portion guide device does not interfere with a discharged sheet or sheets.
Figure 22:
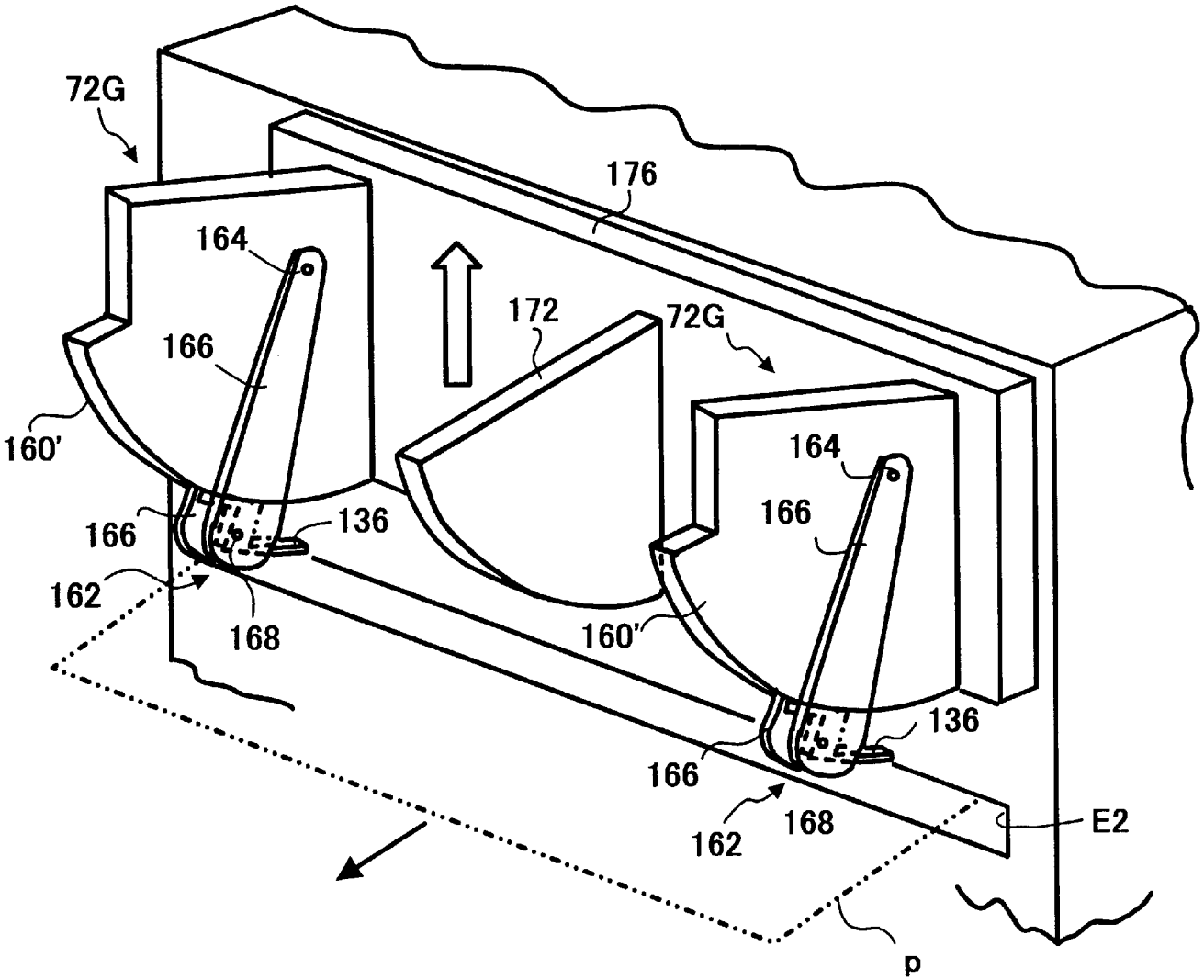
FIG. 22 is a perspective view illustrating a condition of the sheet discharging apparatus of FIG. 17, when the sheet tip portion guide device is positioned at a position in which the sheet tip portion guide device does not interfere with a discharged sheet or sheets.
Figure 23:
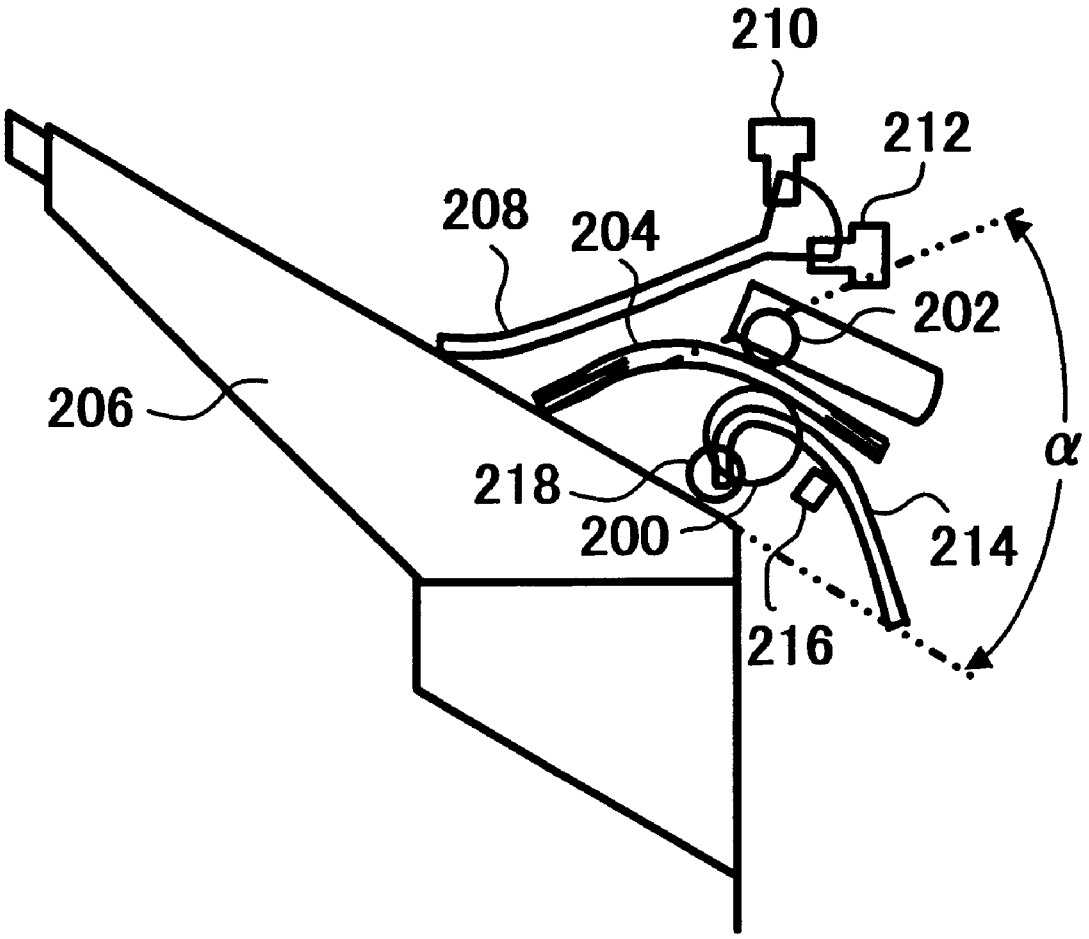
FIG. 23 BACKGROUND ART
FIG. 23 is a side view illustrating a condition of a background sheet discharging apparatus, when an angle ($\alpha$) is formed between a tip portion of a set of stapled sheets and a surface of a sheet discharging tray of the background sheet discharging apparatus.
Figure 24:
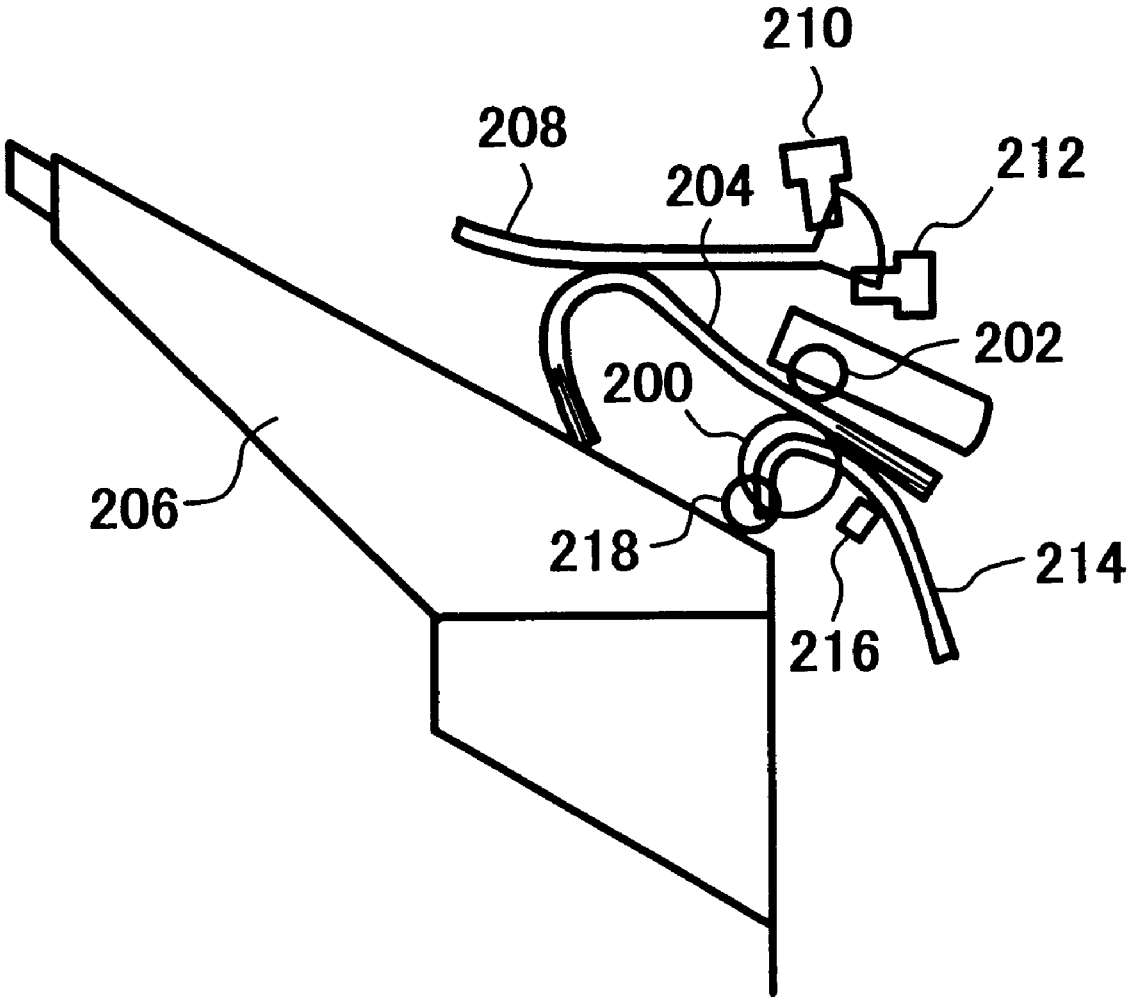
FIG. 24 is a side view illustrating a condition of a background sheet discharging apparatus, when a tip portion of stapled sheets is bent.
Figure 25:
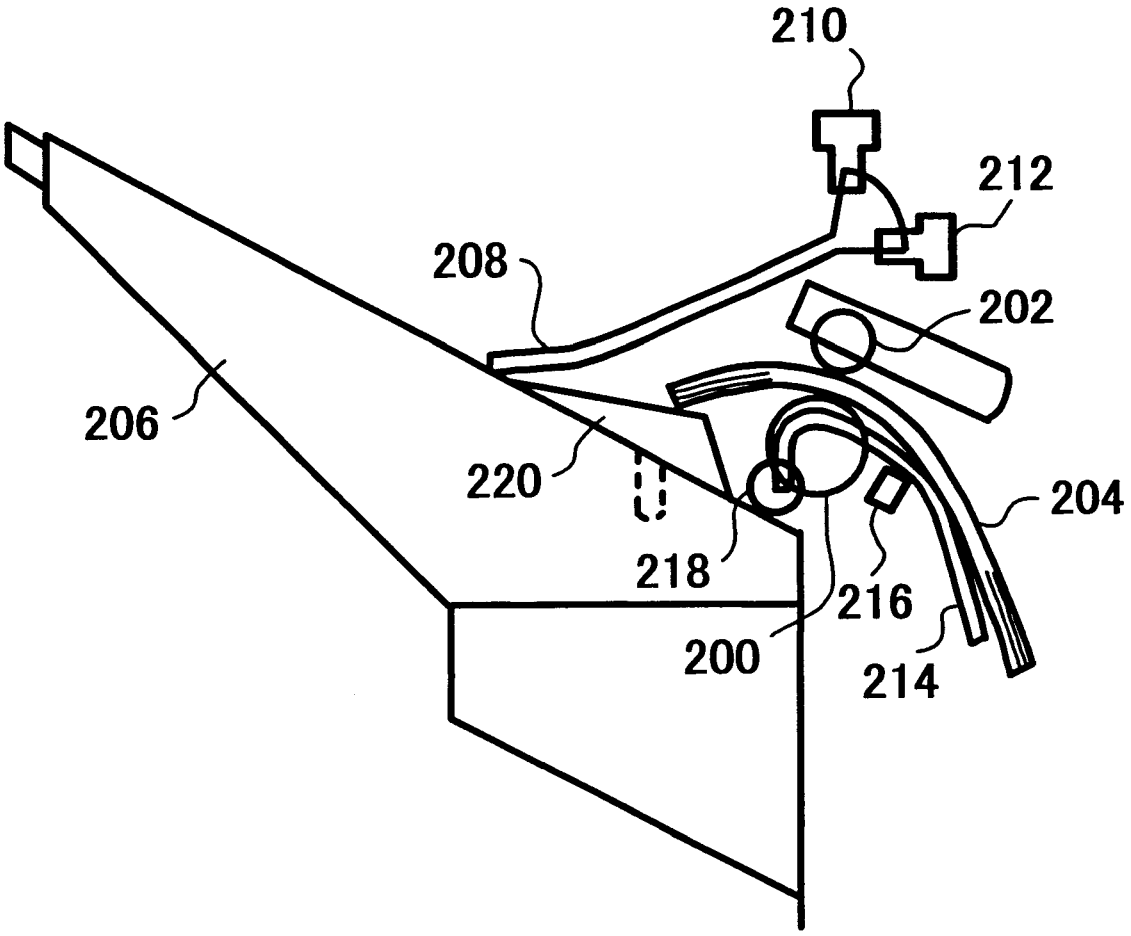
FIG. 25 BACKGROUND ART
FIG. 25 is a side view illustrating a condition of a background sheet discharging apparatus, when an angle is formed between a tip portion of a set of stapled sheets and a surface of a protrusive member of the background sheet discharging apparatus.
Figure 26:
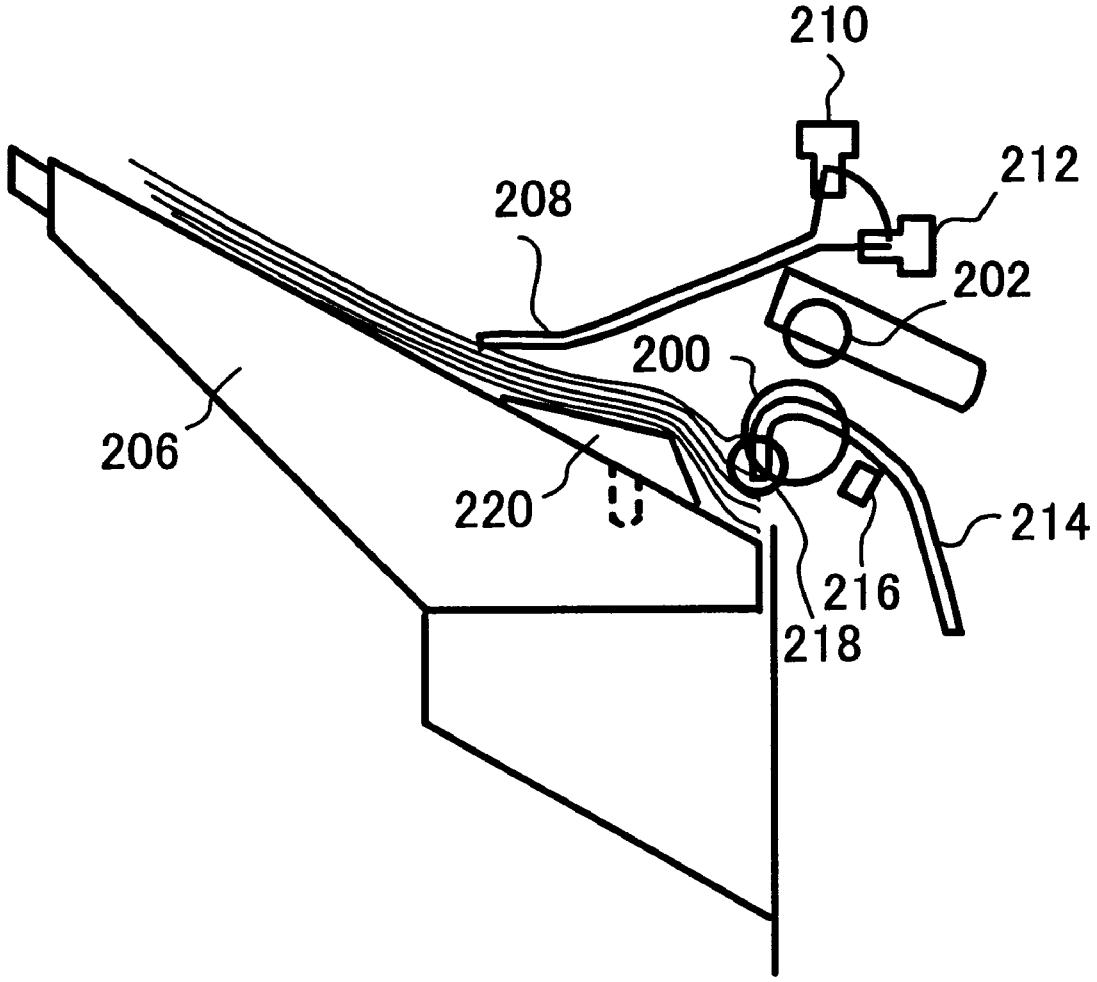
FIG. 26 BACKGROUND ART
FIG. 26 is an explanatory view of inadequate stacking in a background sheet discharging apparatus including a protrusive member.
Figure 27:
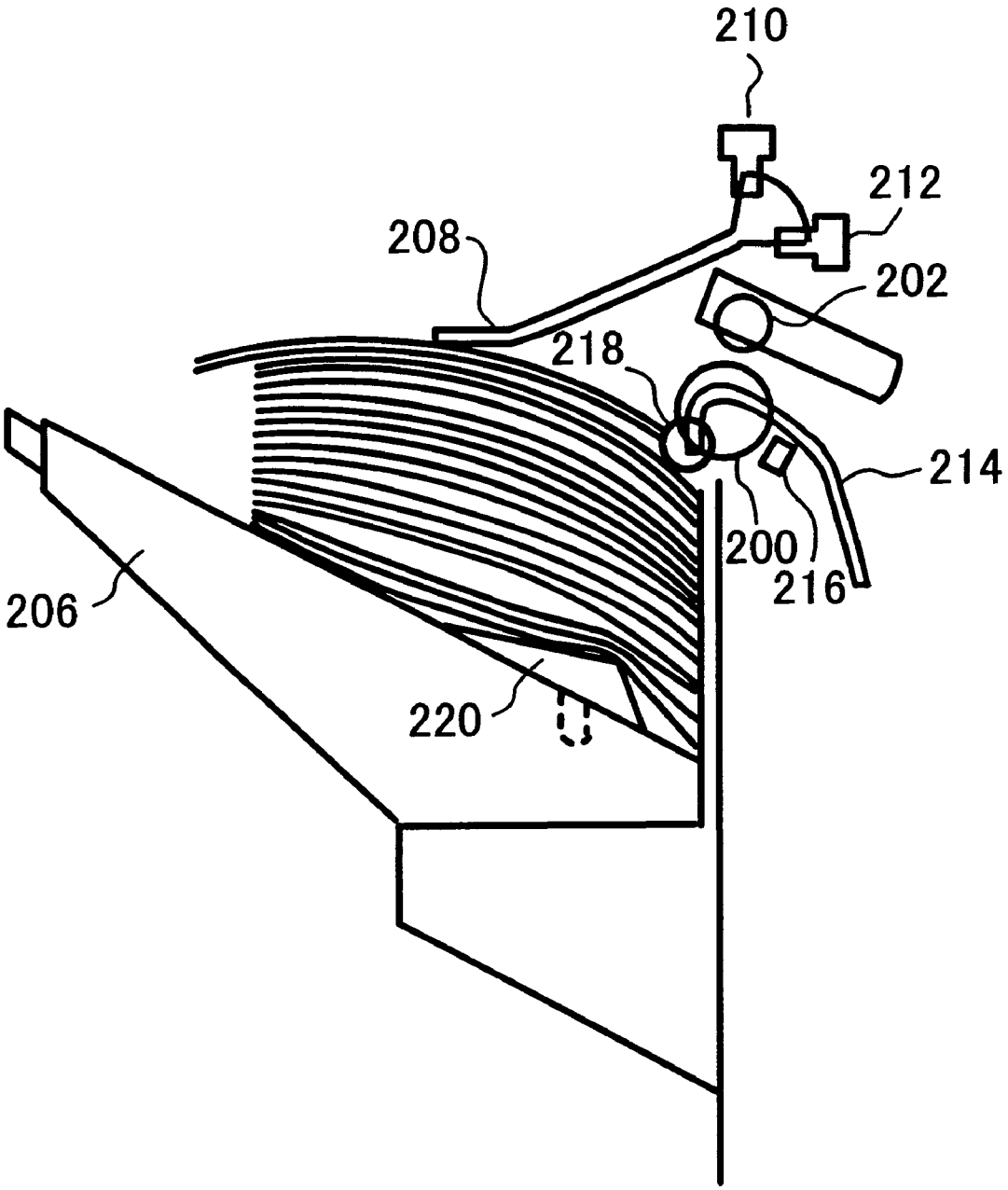
FIG. 27 BACKGROUND ART
FIG. 27 is an explanatory view of another inadequate stacking in a background sheet discharging apparatus including a protrusive member.
Figure 28:
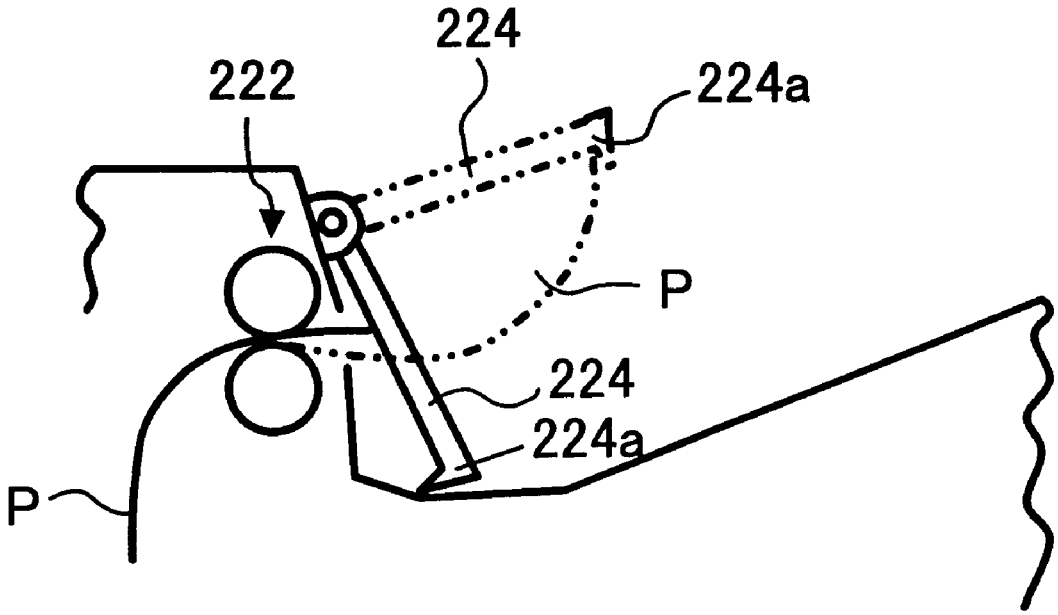
FIG. 28 BACKGROUND ART
FIG. 28 is an explanatory view of an operation of a background sheet discharging apparatus.

A control operation of the control device 188 for the sheet tip portion guide device 72G is described referring to a flowchart illustrated in FIG. 20, and referring to FIGS. 21 and 22.

Referring to the flowchart in FIG. 20, the control device 188 judges if a staple mode is selected based on input information from a control device 98 (illustrated in FIG. 19) of the copying machine in step S1. If the answer is YES in step S1, the control device 188 judges if the number of stapled sheets is X or more in step S2. When stapled sheets are thin and the number of stapled sheets is small, the sheet tip portion guide device 72G may not be pushed by the stapled thin sheets and may interfere with the discharge of the stapled thin sheets. Therefore, the number of stapled sheets is judged relative to X in step S2 to avoid an inadequate discharge of the stapled thin sheets. If the answer is YES in step S2, it may be possible to turn off the solenoid 186 to shift the position of the sheet tip portion guide device 72G to a sheet guide position. However, in this embodiment, an operator's setting for turning on and off the solenoid 186 with the input device 190 is checked first, and the position of the sheet tip portion guide device 72G is controlled based on the above-described operator's setting. Therefore, after step S2, the control device 188 judges if the solenoid 186 is turned off with the input device 190 in step S3. If the answer is YES in step S3, the control device 188 turns off the solenoid 186 and positions the sheet tip portion guide device 72G at a sheet guide position in step S4.

If the answer is NO in step S3, the control device 188 turns on the solenoid 186 so as to shift the sheet tip portion guide device 72G in step S5. Specifically, when the solenoid 186 is turned on, the sheet tip portion guide device 72G is shifted upward to a position in which the sheet tip portion guide device 72G does not interfere with a sheet or sheets discharged from the sheet discharging device 70 as illustrated in FIGS. 21 and 22. Thereby, as illustrated in FIG. 22, a thin paper P, for example, is discharged without being guided by the sheet tip portion guide device 72G.

Returning to step S1 or step S2, if the staple mode is not selected in step S1 or if the number of stapled sheets is not X or more in step S2, the control device 188 judges if the solenoid 186 is turned on with the input device 190 in step S6. If the answer is YES in step S6, the control device 188 turns on the solenoid 186 and shifts the sheet tip portion guide device 72G upward in step S7. If the answer is NO in step S6, the control device 188 turns off the solenoid 186 and positions the sheet tip portion guide device 72G at a sheet guide position in step S4.

In the above-described control operation steps of the present embodiment, though the control device 188 judges based on the information of the staple mode selection, a sheet type setting device 192 may be provided on the operation panel 94 as illustrated in FIG. 19 so as to set a sheet type, for example, a thick sheet and a thin sheet, and the control device 188 may control the operation of the sheet tip guide portion 72G based on the information of the above-described sheet type.

Further, the above-described configuration of the sheet discharging apparatus according to the sixth embodiment may also be applied to each sheet discharging apparatus according to the first through fourth embodiments other than the fifth embodiment.

Furthermore, as an alternative to automatically shifting the position of the sheet tip portion guide device 72G, an operator may turn on and off the solenoid 186 with a switch each time the sheet or sheets are discharged, so as to shift the position of the sheet tip portion guide device 72G.

Obviously, numerous additional modifications and variations of the present invention are possible in light of the above teachings. It is therefore to be understood that within the scope of the appended claims, the present invention may be practiced otherwise than as specifically described herein.

This document is based on Japanese Patent Application No.10-217811 filed in the Japanese Patent Office on Jul. 31, 1998, and on Japanese Patent Application No.11-134253 filed in the Japanese Patent Office on May 14, 1999, the entire contents of which are hereby incorporated by reference.

What is claimed as new and is desired to be secured by Letters Patent of the United States is:

1. A sheet discharging apparatus, comprising:

a sheet discharging device which discharges a sheet on a sheet discharging tray; and a sheet tip portion guide device which holds thereupon a tip portion of the sheet discharged from the sheet discharging device, guides the sheet in a sheet discharging direction while holding the tip portion of the sheet thereupon, and releases the sheet by releasing the tip portion of the sheet held thereupon, wherein the sheet tip portion guide device includes a holding member which holds the tip portion of the sheet thereupon and which moves in the sheet discharging direction with the tip portion of the sheet held thereupon by a pushing force of the sheet discharged from the sheet discharging device to guide the sheet in the sheet discharging direction, and wherein the holding member is configured to swing so as to release the tip portion of the sheet by the pushing force of the sheet discharged from the sheet discharging device, and the sheet discharging apparatus further comprises a swing regulation member so as to regulate rotations of the holding member for a predetermined distance after the holding member starts to move by the pushing force of the sheet discharged from the sheet discharging device.

2. The sheet discharging apparatus according to claim 1, further comprising a displacing device which displaces the swing regulation member such that the holding member is swung at an arbitrary position in the sheet discharging direction to release the tip portion of the sheet.

3. The sheet discharging apparatus according to claim 1, wherein the swing regulation member includes a shape curved upward in the sheet discharging direction.

4. The sheet discharging apparatus according to claim 3, further comprising a catch device which catches the holding member at a position in which the holding member does not interfere with the discharged sheet.

5. The sheet discharging apparatus according to claim 1, wherein the sheet tip portion guide device is configured so as to move to a position in which the sheet tip portion guide device does not interfere with the discharged sheet, and the sheet discharging apparatus further comprises a shifting device which shifts the sheet tip portion guide device to the position.

6. The sheet discharging apparatus according to claim 5, further comprising a control device which controls the shifting device according to a sheet process mode so as to shift the sheet tip portion guide device selectively between a sheet guide position and the position in which the sheet tip portion guide device does not interfere with the discharged sheet.

7. The sheet discharging apparatus according to claim 1, further comprising a sheet correction member provided in a vicinity of the sheet discharging device to regulate a change of a shape of the sheet at substantially a central part of the sheet in the direction perpendicular to the sheet discharging direction.

8. A sheet discharging apparatus, comprising:

means for discharging a sheet on a sheet discharging tray; and means for holding thereupon a tip portion of the sheet discharged from the sheet discharging means, for guiding the sheet in a sheet discharging direction while holding the tip portion of the sheet thereupon, and for releasing the sheet by releasing the tip portion of the sheet held thereupon, wherein the sheet tip portion guide means includes means for holding the tip portion of the sheet thereupon and moving in the sheet discharging direction with the tip portion of the sheet held thereupon by a pushing force of the sheet discharged from the sheet discharging means to guide the sheet in the sheet discharging direction, and wherein the holding means is configured to swing so as to release the tip portion of the sheet by the pushing force of the sheet discharged from the sheet discharging means, and the sheet discharging apparatus further comprises means for regulating rotations of the holding means for a predetermined distance after the holding means starts to move by the pushing force of the sheet discharged from the sheet discharging means.

9. The sheet discharging apparatus according to claim 8, further comprising means for displacing the swing regulation means such that the holding means is swung at an arbitrary position in the sheet discharging direction to release the tip portion of the sheet.

10. The sheet discharging apparatus according to claim 8, wherein the swing regulation means includes a shape curved upward in the sheet discharging direction.

11. The sheet discharging apparatus according to claim 10, further comprising means for catching the holding means at a position in which the holding means does not interfere with the discharged sheet.

12. The sheet discharging apparatus according to claim 8, wherein the sheet tip portion guide means is configured so as to move to a position in which the sheet tip portion guide means does not interfere with the discharged sheet, and the sheet discharging apparatus further comprises means for shifting the sheet tip portion guide means to the position.

13. The sheet discharging apparatus according to claim 12, further comprising means for controlling the shifting means according to a sheet process mode so as to shift the sheet tip portion guide means selectively between a sheet guide position and the position in which the sheet tip portion guide means does not interfere with the discharged sheet.

14. The sheet discharging apparatus according to claim 8, further comprising means for regulating a change of a shape of the sheet at substantially a central part of the sheet in the direction perpendicular to the sheet discharging direction in a vicinity of the sheet discharging means.

15. A method for discharging a sheet on a sheet discharging tray of a sheet discharging apparatus, the method comprising the steps of:

discharging a sheet from a sheet discharging device of the sheet discharging apparatus;

holding a tip portion of the sheet discharged from the sheet discharging device by a sheet tip portion guide device of the sheet discharging apparatus and guiding the sheet in a sheet discharging direction while holding the tip portion of the sheet by the sheet tip portion guide device; and releasing the sheet by releasing the tip portion of the sheet held by the sheet tip portion guide devices, wherein the sheet tip portion guide device includes a holding member which holds the tip portion of the sheet thereupon and which moves in the sheet discharging direction with the tip portion of the sheet held thereupon by a pushing force of the sheet discharged from the sheet discharging device to guide the sheet in the sheet discharging direction, and wherein the holding member is configured to swing so as to release the tip portion of the sheet by the pushing force of the sheet discharged from the sheet discharging device, and the sheet discharging apparatus further comprises a swing regulation member so as to regulate rotations of the holding member for a predetermined distance after the holding member starts to move by the pushing force of the sheet discharged from the sheet discharging device.

16. The sheet discharging method according to claim 15, wherein the releasing step further includes the step of displacing the swing regulation member such that the holding member is swung at an arbitrary position in the sheet discharging direction to release the tip portion of the sheet.

17. The sheet discharging method according to claim 15, wherein the swing regulation member includes a shape curved upward in the sheet discharging direction.

18. The sheet discharging method according to claim 17, further comprising a step of catching the holding member at a position in which the holding member does not interfere with the discharged sheet.

19. The sheet discharging method according to claim 15, wherein the sheet tip portion guide device is configured so as to move to a position in which the sheet tip portion guide device does not interfere with the discharged sheet, and the sheet discharging method further comprises the step of shifting the sheet tip portion guide device to the position.

20. The sheet discharging method according to claim 19, wherein the sheet tip portion guide device is selectively shifted between a sheet guide position and the position in which the sheet tip portion guide device does not interfere with the discharged sheet according to a sheet process mode.

21. The sheet discharging method according to claim 19, further comprising the step of regulating a change of a shape of the sheet at substantially a central part of the sheet in the direction perpendicular to the sheet discharging direction.

* * * * *